US007127914B2

(12) United States Patent
Roberts et al.

(10) Patent No.: US 7,127,914 B2
(45) Date of Patent: Oct. 31, 2006

(54) HYBRID GAS LIQUEFACTION CYCLE WITH MULTIPLE EXPANDERS

(75) Inventors: Mark Julian Roberts, Kempton, PA (US); Christopher Geoffrey Spilsbury, Haslemere (GB); Adam Adrian Brostow, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 429 days.

(21) Appl. No.: 10/664,336

(22) Filed: Sep. 17, 2003

(65) Prior Publication Data

US 2005/0056051 A1 Mar. 17, 2005

(51) Int. Cl.
*F25J 1/00* (2006.01)
*F25B 7/00* (2006.01)

(52) U.S. Cl. ..... 62/612; 62/335

(58) Field of Classification Search ..... 62/611, 62/612, 613, 335

See application file for complete search history.

(56) References Cited

U.S. PATENT DOCUMENTS

| | | | | |
|---|---|---|---|---|
| 3,511,058 A | | 5/1970 | Becker | |
| 3,818,714 A | | 6/1974 | Etzbach et al. | |
| 4,680,041 A | * | 7/1987 | DeLong | 62/612 |
| 4,755,200 A | * | 7/1988 | Liu et al. | 62/612 |
| 4,765,813 A | | 8/1988 | Winters Jr., et al. | |
| 5,473,900 A | * | 12/1995 | Low | 62/611 |
| 5,755,114 A | | 5/1998 | Foglietta | |
| 5,768,912 A | | 6/1998 | Dubar | |

(Continued)

FOREIGN PATENT DOCUMENTS

| | | |
|---|---|---|
| DE | 24 40 215 | 3/1976 |
| DE | 101 08 905 A | 9/2002 |
| FR | 1 345 823 A | 12/1963 |

OTHER PUBLICATIONS

Full International Search Report dated Feb. 1, 2005.
U.S. Appl. No. 10/444,029, Brostow et al.

(Continued)

*Primary Examiner*—William C. Doerrier
(74) *Attorney, Agent, or Firm*—Willard Jones, II

(57) ABSTRACT

Method for gas liquefaction comprising cooling a feed gas by a first refrigeration system in a first heat exchange zone and withdrawing a substantially liquefied stream therefrom, further cooling the substantially liquefied stream by indirect heat exchange with one or more work-expanded refrigerant streams in a second heat exchange zone, and withdrawing therefrom a further cooled, substantially liquefied stream. At least one of the one or more work-expanded refrigerant streams is provided by compressing one or more refrigerant gases to provide a compressed refrigerant stream, cooling all or a portion of the compressed refrigerant stream in a third heat exchange zone to provide a cooled, compressed refrigerant stream, and work expanding the cooled, compressed refrigerant stream to provide one of the one or more work-expanded refrigerant streams. The flow rate of a work-expanded refrigerant stream in the second heat exchange zone typically is less than the total flow rate of one or more work-expanded refrigerant streams in the third heat exchange zone.

32 Claims, 9 Drawing Sheets

U.S. PATENT DOCUMENTS

| | | | | |
|---|---|---|---|---|
| 5,916,260 | A | 6/1999 | Dubar | |
| 6,041,620 | A | 3/2000 | Olszewski et al. | |
| 6,062,041 | A | 5/2000 | Kikkawa et al. | |
| 6,250,244 | B1 | 6/2001 | Dubar et al. | |
| 6,308,531 | B1 | 10/2001 | Roberts et al. | |
| 6,412,302 | B1 | 7/2002 | Foglietta | |
| 6,446,465 | B1 | 9/2002 | Dubar | |
| 6,449,984 | B1 | 9/2002 | Paradowski | |
| 6,722,157 | B1 * | 4/2004 | Eaton et al. | 62/612 |

OTHER PUBLICATIONS

"SDG&E: Experience pays off for peak shaving pioneer", Cryogenics & Industrial Gases, Sep./Oct. 1971, pp. 25-28.

D.T.Linnett, "MRC Cycle for LNG/Air Separation Saves Money", 10th Australian Chemical Engineering Conference, Sydney, Australia, Aug. 24-26, 1982, pp. 280-286.

Karlheinz Muller and Wolfgang Forg, "Natural Gas Liquefaction by an Expansion-Turbine Mixture Cycle", Chemical Economy & Engineering Review, Oct. 1976 vol. 8, No. 10 (No. 99).

* cited by examiner

HYBRID GAS LIQUEFACTION CYCLE WITH MULTIPLE EXPANDERS

BACKGROUND OF THE INVENTION

Gas liquefaction is achieved by cooling and condensing a feed gas stream against multiple refrigerant streams provided by one or more recirculating refrigeration systems. Cooling of the feed gas is accomplished by various cooling process cycles such as the well-known cascade cycle in which refrigeration is provided by three different refrigerant loops. In the liquefaction of natural gas, for example, a cascade refrigeration system may be utilized with methane, ethylene and propane cycles in sequence to produce refrigeration at three different temperature levels. Another well-known refrigeration cycle uses a propane pre-cooled, mixed refrigerant cycle in which a multicomponent refrigerant mixture generates refrigeration over a selected temperature range. The mixed refrigerant can contain hydrocarbons such as methane, ethane, propane, and other light hydrocarbons, and also may contain nitrogen. Versions of this efficient refrigeration system are used in many operating liquefied natural gas (LNG) plants around the world.

Another type of refrigeration process for natural gas liquefaction utilizes a gas expansion cycle in which a refrigerant gas such as nitrogen is compressed and cooled to ambient conditions with air or water cooling and is further cooled by countercurrent heat exchange with cold low-pressure nitrogen gas. The cooled nitrogen stream then is work expanded through a turbo-expander to produce the cold low-pressure nitrogen gas, and this gas is used to cool the natural gas feed and the compressed nitrogen stream. The work produced by nitrogen expansion can be used to drive a nitrogen booster compressor connected to the shaft of the expander. In this process, the cold expanded nitrogen is used to liquefy the natural gas and also to cool the compressed nitrogen gas in the same heat exchanger. The cooled pressurized nitrogen is further cooled in the work expansion step to provide the cold nitrogen refrigerant.

Integrated refrigeration systems can be used for gas liquefaction wherein cooling of the gas from ambient to an intermediate temperature is provided by one or more vapor recompression cycles and cooling from the intermediate temperature to the final liquefaction temperature is provided by a gas expansion cycle. Examples of these combined liquefaction cycles are disclosed in German Patent DE 2440215 and in U.S. Pat. Nos. 5,768,912, 6,062,041, 6,308,531 B1, and 6,446,465 B1.

In the processes described in DE 2440215 and in U.S. Pat. Nos. 5,768,912 and 6,446,465 B1, feed gas and compressed refrigerant gas from the gas expansion cycle are cooled together in common heat exchangers using refrigeration provided by the cold work-expanded refrigerant. In an alternative method disclosed in U.S. Pat. No. 6,308,531 B1, feed gas and compressed refrigerant gas from the gas expansion cycle are cooled in separate heat exchangers using refrigeration provided by the cold work-expanded refrigerant. In this method, additional refrigeration from the vapor recompression cycle is used to provide additional cooling of the compressed refrigerant gas in the gas expansion cycle. This may be accomplished by passing a stream of refrigerant from the vapor recompression cycle through the heat exchanger cooling the compressed refrigerant gas. Alternatively, a portion of the gas expansion cycle compressed refrigerant gas may be cooled against vaporizing refrigerant in the vapor recompression cycle heat exchangers to provide additional refrigeration.

The liquefaction of natural gas is a very energy intensive process. Improved efficiency and operating flexibility of gas liquefaction processes using combined vapor recompression and gas expansion refrigeration cycles are highly desirable and are among the objectives for new cycles being developed in the gas liquefaction art. Embodiments of the present invention address this need by providing multiple expanders in the gas expansion cycle to reduce or eliminate the need for balance refrigeration between the vapor recompression and gas expansion cycles while allowing cooling of the feed gas and the compressed gas expansion refrigerant in separate heat exchangers and also allowing independent operation of the vapor recompression and gas expansion cycles.

BRIEF SUMMARY OF THE INVENTION

In one embodiment of the invention, a process for gas liquefaction comprises cooling a feed gas in a first heat exchange zone by indirect heat exchange with one or more refrigerant streams provided in a first refrigeration system, and withdrawing a substantially liquefied stream from the first heat exchange zone. The substantially liquefied stream is further cooled in a second heat exchange zone by indirect heat exchange with one or more work-expanded refrigerant streams provided by a second refrigeration system and a further cooled, substantially liquefied stream is withdrawn from the second heat exchange zone. Two or more cooled compressed refrigerant streams are work expanded in the second refrigeration system to provide at least one of the one or more work-expanded refrigerant streams in the second heat exchange zone.

The operation of the second refrigeration system includes the steps of compressing one or more refrigerant gases to provide a compressed refrigerant stream; cooling all or a portion of the compressed refrigerant stream in a third heat exchange zone to provide a cooled, compressed refrigerant stream; and work expanding the cooled, compressed refrigerant stream to provide one of the one or more work-expanded refrigerant streams. The flow rate of a work-expanded refrigerant stream in the second heat exchange zone is less than the total flow rate of one or more work-expanded refrigerant streams in the third heat exchange zone.

Typically, no cooling of the feed gas or the cooled feed stream occurs in the third heat exchange zone. The flow rate of a compressed refrigerant stream being cooled in the third heat exchange zone may be less than the total flow rate of one or more work-expanded refrigerant streams being warmed in the third heat exchange zone. Typically, the first refrigeration system operates independently of the second refrigeration system.

The cooling of the feed gas in the first heat exchange zone may be effected by a method comprising compressing and cooling a refrigerant gas containing one or more components to provide a cooled and at least partially condensed refrigerant, reducing the pressure of the cooled and at least partially condensed refrigerant to provide a vaporizing refrigerant, and cooling the feed gas by indirect heat exchange with the vaporizing refrigerant in the first heat exchange zone to provide the substantially liquefied stream and the refrigerant gas. The feed gas may be cooled prior to the first heat exchange zone by indirect heat exchange with a second vaporizing refrigerant. At least a portion of the cooling of the refrigerant gas after compression may be provided by indirect heat exchange with a second vaporizing refrigerant.

A first portion of the compressed refrigerant gas may be cooled in the third heat exchange zone and a second portion of the compressed refrigerant gas may be cooled, work expanded, and warmed in the third heat exchange zone to provide refrigeration therein for cooling the first portion of the compressed refrigerant gas.

In an alternative embodiment, the compressed refrigerant gas may be cooled in the third heat exchange zone and work expanded to provide a first work-expanded refrigerant, the first work-expanded refrigerant may be divided into a first and a second cooled refrigerant, the first cooled refrigerant may be warmed in the third heat exchange zone to provide refrigeration therein for cooling the compressed refrigerant gas, the second cooled refrigerant may be further cooled and work expanded to provide a second work-expanded refrigerant, and the second work-expanded refrigerant may be warmed in the second heat exchange zone to provide refrigeration therein for cooling the substantially liquefied stream from the first heat exchange zone.

In another embodiment, a first portion of the compressed refrigerant gas may be cooled in the third heat exchange zone and work expanded to provide a first work-expanded refrigerant, a second portion of the compressed refrigerant gas may be cooled by indirect heat exchange with a vaporizing refrigerant provided by a third refrigeration system and work expanded to provide a second work-expanded refrigerant, and the first and second work-expanded refrigerants may be warmed in the second heat exchange zone to provide refrigeration therein for cooling the substantially liquefied stream from the first heat exchange zone.

In another alternative embodiment, the compressed refrigerant gas may be cooled in the third heat exchange zone to provide a cooled compressed refrigerant gas, wherein a portion of the cooled compressed refrigerant gas may be work expanded and warmed in the second heat exchange zone to provide cooling therein for the substantially liquefied stream from the first heat exchange zone.

The second refrigeration system may be operated according to a first alternative embodiment by a method comprising (d) compressing a first refrigerant gas to provide the compressed refrigerant gas, and dividing the compressed refrigerant gas into first and second compressed refrigerants;

(e) cooling the first compressed refrigerant in the third heat exchange zone to provide a first cooled compressed refrigerant, work expanding the first cooled compressed refrigerant to provide a cold work-expanded refrigerant, warming the cold work-expanded refrigerant in the second heat exchange zone to provide refrigeration for cooling the cooled feed stream therein, and withdrawing an intermediate refrigerant therefrom;

(f) cooling the second compressed refrigerant by indirect heat exchange with a vaporizing refrigerant to provide a second cooled compressed refrigerant, work expanding the second cooled compressed refrigerant to provide a work-expanded second refrigerant, and combining the work expanded second refrigerant with the intermediate refrigerant to provide a combined intermediate refrigerant; and (g) warming the combined intermediate refrigerant in the third heat exchange zone to provide refrigeration for cooling the first compressed refrigerant therein, and withdrawing therefrom a warm refrigerant to provide the first refrigerant gas.

The second refrigeration system may be operated according to a second alternative embodiment by a method comprising (d) compressing a first refrigerant gas to provide the compressed refrigerant gas;

(e) cooling the compressed refrigerant gas in the third heat exchange zone to provide a cooled compressed refrigerant, and dividing the cooled compressed refrigerant into a first and a second cooled compressed refrigerant;

(f) further cooling the first cooled compressed refrigerant in the third heat exchange zone to provide a first further cooled refrigerant;

(g) work expanding the first further cooled refrigerant to provide a work-expanded first refrigerant and work expanding the second cooled compressed refrigerant to provide a work-expanded second refrigerant;

(h) warming the first work-expanded refrigerant and the second work-expanded refrigerant in the second heat exchange zone to provide refrigeration therein for cooling the substantially liquefied stream from the first heat exchange zone and withdrawing a combined intermediate refrigerant from the second heat exchange zone; and (i) warming the combined intermediate refrigerant in the third heat exchange zone to provide refrigeration for cooling the first compressed refrigerant therein and withdrawing therefrom a warmed refrigerant to provide the first refrigerant gas.

In a third alternative embodiment, the second refrigeration system may be operated by a method comprising (d) compressing the first refrigerant gas and a second refrigerant gas in a multi-stage refrigerant compressor to provide a compressed refrigerant gas, and dividing the compressed refrigerant gas into a first and a second compressed refrigerant;

(e) cooling the first compressed refrigerant in the third heat exchange zone to provide a first cooled compressed refrigerant and work expanding the first cooled compressed refrigerant to provide a cold work-expanded refrigerant at a first pressure, and warming the cold work-expanded refrigerant in the second heat exchange zone to provide refrigeration therein for cooling the substantially liquefied stream from the first heat exchange zone and withdrawing an intermediate refrigerant from the second heat exchange zone;

(f) cooling the second compressed refrigerant by indirect heat exchange with a vaporizing refrigerant to provide a second cooled compressed refrigerant, work expanding the second cooled compressed refrigerant to provide a work-expanded second refrigerant at a second pressure greater than the first pressure, warming the work-expanded second refrigerant in the third heat exchange zone to provide refrigeration for cooling the first compressed refrigerant therein, and withdrawing therefrom a warmed refrigerant to provide the second refrigerant gas;

(g) warming the intermediate refrigerant in the third heat exchange zone to provide refrigeration for cooling the first compressed refrigerant therein, and withdrawing therefrom a warmed refrigerant to provide the first refrigerant gas; and (h) introducing the first refrigerant gas into a first stage of the multi-stage refrigerant compressor and introducing the second refrigerant gas into an intermediate stage of the multi-stage refrigerant compressor.

The second refrigeration system may be operated according to a fourth alternative embodiment comprising (d) compressing a refrigerant gas to provide the compressed refrigerant gas, and dividing the compressed refrigerant gas into a first and a second compressed refrigerant;

(e) cooling the first compressed refrigerant in the third heat exchange zone to provide a first cooled compressed refrigerant and work expanding the first cooled compressed refrigerant to provide a first work-expanded refrigerant;

(f) cooling the first work-expanded refrigerant in the second heat exchange zone to provide a cooled first work-expanded refrigerant, work expanding the cooled first work-expanded refrigerant to provide a cold work-expanded refrigerant, warming the cold work-expanded refrigerant in the second heat exchange zone to provide refrigeration therein for cooling the substantially liquefied stream from the first heat exchange zone, and withdrawing an intermediate refrigerant from the second heat exchange zone;

(g) cooling the second compressed refrigerant by indirect heat exchange with a vaporizing refrigerant to provide a second cooled compressed refrigerant, work expanding the second cooled compressed refrigerant to provide a work expanded second refrigerant, and combining the work-expanded second refrigerant with the intermediate refrigerant to provide a combined refrigerant; and (h) warming the combined refrigerant in the third heat exchange zone to provide refrigeration for cooling the first compressed refrigerant therein and withdrawing therefrom the first refrigerant gas.

In a fifth alternative embodiment, the second refrigeration system may be operated by a method comprising (d) compressing a first refrigerant gas and a second refrigerant gas in a multi-stage refrigerant compressor to provide the compressed refrigerant gas;

(e) cooling the compressed refrigerant gas in the third heat exchange zone to provide a first cooled compressed refrigerant, work expanding the first cooled compressed refrigerant to provide a first cold work-expanded refrigerant at a first pressure, and dividing the first cold work-expanded refrigerant into a first and a second cold refrigerant;

(f) warming the first cold refrigerant in the third heat exchange zone to provide refrigeration for cooling the first compressed refrigerant therein and withdrawing therefrom a warmed refrigerant to provide the second refrigerant gas;

(g) cooling the second cold refrigerant in the second heat exchange zone to provide a second cooled compressed refrigerant, work expanding the second cooled compressed refrigerant to provide a second work-expanded refrigerant at a second pressure that is less than the first pressure;

(h) warming the second work-expanded refrigerant in the second heat exchange zone to provide refrigeration therein for cooling the substantially liquefied stream from the first heat exchange zone and to provide refrigeration for cooling the first compressed refrigerant in the third heat exchange zone, and withdrawing therefrom a warmed refrigerant to provide the first refrigerant gas; and (i) introducing the first refrigerant gas into a first stage of the multi-stage refrigerant compressor and introducing the second refrigerant gas into an intermediate stage of the multi-stage refrigerant compressor.

The second refrigeration system may be operated according to a sixth alternative embodiment comprising (d) compressing a refrigerant gas to provide the compressed refrigerant gas, and dividing the compressed refrigerant gas into a first and a second compressed refrigerant;

(e) cooling the first compressed refrigerant in the third heat exchange zone to provide a first cooled compressed refrigerant and work expanding the first cooled compressed refrigerant to provide a cold work-expanded first refrigerant, warming the cold work-expanded first refrigerant in the second heat exchange zone to provide refrigeration therein for cooling the substantially liquefied stream from the first heat exchange zone, and form a partially-warmed refrigerant in the second heat exchange zone;

(f) cooling the second compressed refrigerant by indirect heat exchange with a vaporizing refrigerant to provide an intermediate cooled refrigerant, further cooling the intermediate cooled refrigerant in the third heat exchange zone to provide a cooled second compressed refrigerant, and work expanding the second cooled compressed refrigerant to provide a work-expanded second refrigerant;

(g) combining the cold work-expanded second refrigerant and the partially-warmed refrigerant to provide a combined intermediate refrigerant, warming the combined intermediate refrigerant in the second heat exchange zone to provide additional refrigeration therein for cooling the substantially liquefied stream from the first heat exchange zone, and withdrawing a partially warmed refrigerant from the second heat exchange zone; and (h) warming the partially warmed refrigerant in the third heat exchange zone to provide refrigeration for cooling the first compressed refrigerant and the second compressed refrigerant therein, withdrawing therefrom a warmed refrigerant to provide the first refrigerant gas.

In this sixth embodiment, additional refrigeration may be provided to the third heat exchange zone by warming therein a portion of the one or more refrigerants provided in the first refrigeration system. Additional refrigeration may be provided to the first heat exchange zone by warming therein a portion of the intermediate cooled refrigerant provided in the second refrigeration system.

The second refrigeration system may be operated according to a seventh alternative embodiment comprising (d) compressing a first refrigerant gas and a second refrigerant gas in a multi-stage refrigerant compressor to provide the compressed refrigerant gas;

(e) cooling the compressed refrigerant gas in the third heat exchange zone to provide a cooled compressed refrigerant and dividing the cooled compressed refrigerant into a first and a second cooled refrigerant;

(f) work expanding the first cooled refrigerant to provide a first work-expanded refrigerant at a first pressure, warming the first work-expanded refrigerant in the second heat exchange zone to provide refrigeration therein for cooling the substantially liquefied stream from the first heat exchange zone and to provide refrigeration for cooling the first compressed refrigerant in the third heat exchange zone, and withdrawing therefrom a warmed refrigerant to provide the second refrigerant gas;

(g) cooling the second cooled refrigerant in the second heat exchange zone to provide a second cooled compressed refrigerant, work expanding the second cooled compressed refrigerant to provide a second work-expanded refrigerant at a second pressure that is less than the first pressure;

(h) warming the second work-expanded refrigerant to provide refrigeration for cooling the cooled feed stream in the second heat exchange zone and to provide refrigeration for cooling the first compressed refrigerant in the third heat exchange zone, and withdrawing therefrom a warmed refrigerant to provide the first refrigerant gas; and (i) introducing the first refrigerant gas into a first stage of the multi-stage refrigerant compressor and introducing the second refrigerant gas into an intermediate stage of the multi-stage refrigerant compressor.

In all embodiments, the feed gas may comprise natural gas. In all embodiments, the one or more refrigerants provided in the first refrigeration system may be selected from the group consisting of nitrogen, hydrocarbons containing one or more carbon atoms, and halocarbons containing one or more carbon atoms. Also, in all embodiments, the refrigerant gas in the second refrigeration system may comprise one or more components selected from the group consisting of nitrogen, argon, methane, ethane, and propane.

In a final process embodiment, the method for gas liquefaction may comprise (a) cooling a feed gas in a first heat exchange zone by indirect heat exchange with one or more refrigerants provided in a first refrigeration system, and withdrawing a substantially liquefied stream from the first heat exchange zone; and (b) further cooling the substantially liquefied stream in a second heat exchange zone by indirect heat exchange with a cold work-expanded refrigerant and withdrawing therefrom a further cooled, substantially liquefied stream;

wherein the cold work-expanded refrigerant is provided in a second refrigeration system comprising at least two refrigeration circuits by a method which includes (1) compressing a refrigerant gas in a first refrigeration circuit to provide a compressed refrigerant gas;

(2) cooling the compressed refrigerant gas in a third heat exchange zone to provide a cooled, compressed refrigerant gas, wherein a portion of the cooling is provided therein by vaporizing a multicomponent refrigerant provided by a second refrigeration circuit;

(3) work expanding the cooled, compressed refrigerant gas to provide the cold work-expanded refrigerant; and (4) warming the cold work-expanded refrigerant in the second heat exchange zone to provide refrigeration therein for cooling the substantially liquefied stream from the first heat exchange zone and to provide refrigeration for cooling the compressed refrigerant gas in the third heat exchange zone, and withdrawing therefrom a warmed refrigerant to provide the refrigerant gas.

Typically, no cooling of the feed gas or the cooled feed stream occurs in the third heat exchange zone.

In a method for gas liquefaction comprising (a) cooling a feed gas in a first heat exchange zone by indirect heat exchange with one or more refrigerants provided in a first refrigeration system, thereby providing a cooled feed stream; and (b) further cooling the cooled feed stream in a second heat exchange zone by indirect heat exchange with a work-expanded refrigerant provided by a second refrigeration system and withdrawing a further cooled stream from the second heat exchange zone, wherein the operation of the second refrigeration system includes the steps of (1) compressing a refrigerant gas to provide a compressed refrigerant;

(2) cooling the compressed refrigerant to provide a cooled, compressed refrigerant;

(3) work expanding the cooled, compressed refrigerant to provide the work-expanded refrigerant;

wherein refrigeration for the cooling of the compressed refrigerant is provided in part by indirect heat exchange in a third heat exchange zone with work-expanded refrigerant from the second heat exchange zone and in part by balance refrigeration provided by the first refrigeration system;

an embodiment of the invention may comprise reducing or eliminating the need for the balance refrigeration by cooling and work expanding a portion of the compressed refrigerant to provide an additional work-expanded refrigerant, and utilizing the additional work-expanded refrigerant to provide additional refrigeration to the third heat exchange zone.

Embodiments of the invention may be carried out in a system for gas liquefaction comprising:

(a) a first refrigeration system and first heat exchange means adapted for cooling a feed gas by indirect heat exchange with one or more refrigerants provided by the first refrigeration system in order to provide a substantially liquefied stream;

(b) a second refrigeration system and second heat exchange means adapted for further cooling of the substantially liquefied stream by indirect heat exchange with one or more cold work-expanded refrigerants provided by the second refrigeration system in order to provide a further cooled, substantially liquefied stream;

(c) gas compression means for compressing one or more refrigerant gas streams and third heat exchange means adapted for cooling one or more compressed refrigerant gas streams in the second refrigeration system;

(d) two or more expanders for work expanding cooled compressed refrigerant gas streams in the second refrigeration system to provide two or more cold work-expanded refrigerant streams; and (e) piping means to transfer the two or more cold work-expanded refrigerant streams from the two or more expanders to the second heat exchange means or to the second and third heat exchange means.

In this system, the third heat exchange means typically is not adapted for cooling of the feed gas or the cooled feed stream. The system may further comprise a third refrigeration system adapted for cooling at least one of the one or more compressed refrigerant gas streams of the second refrigeration system. The third refrigeration system may be adapted for cooling the feed gas prior to the first heat exchange means.

An alternative system for gas liquefaction comprises (a) a first refrigeration system and first heat exchange means adapted for cooling a feed gas by indirect heat exchange with one or more refrigerants provided by the first refrigeration system in order to provide a substantially liquefied stream;

(b) a second refrigeration system and second heat exchange means adapted for further cooling of the substantially liquefied stream by indirect heat exchange with one or more cold work-expanded refrigerants provided by the second refrigeration system in order to provide a further cooled, substantially liquefied stream;

(c) gas compression means for compressing a refrigerant gas stream and third heat exchange means adapted for cooling one or more compressed refrigerant streams;

(d) a third refrigeration system adapted to provide additional refrigeration to the third heat exchange means;

(e) an expander for work expanding a cooled compressed refrigerant stream in the second refrigeration system to provide a cold work-expanded refrigerant stream; and (f) piping means to transfer the cold work-expanded refrigerant stream from the expander to the second heat exchange means.

Typically, the third heat exchange means is not adapted for cooling of the feed gas or the cooled feed stream.

DETAILED DESCRIPTION OF THE INVENTION

Figure 1:
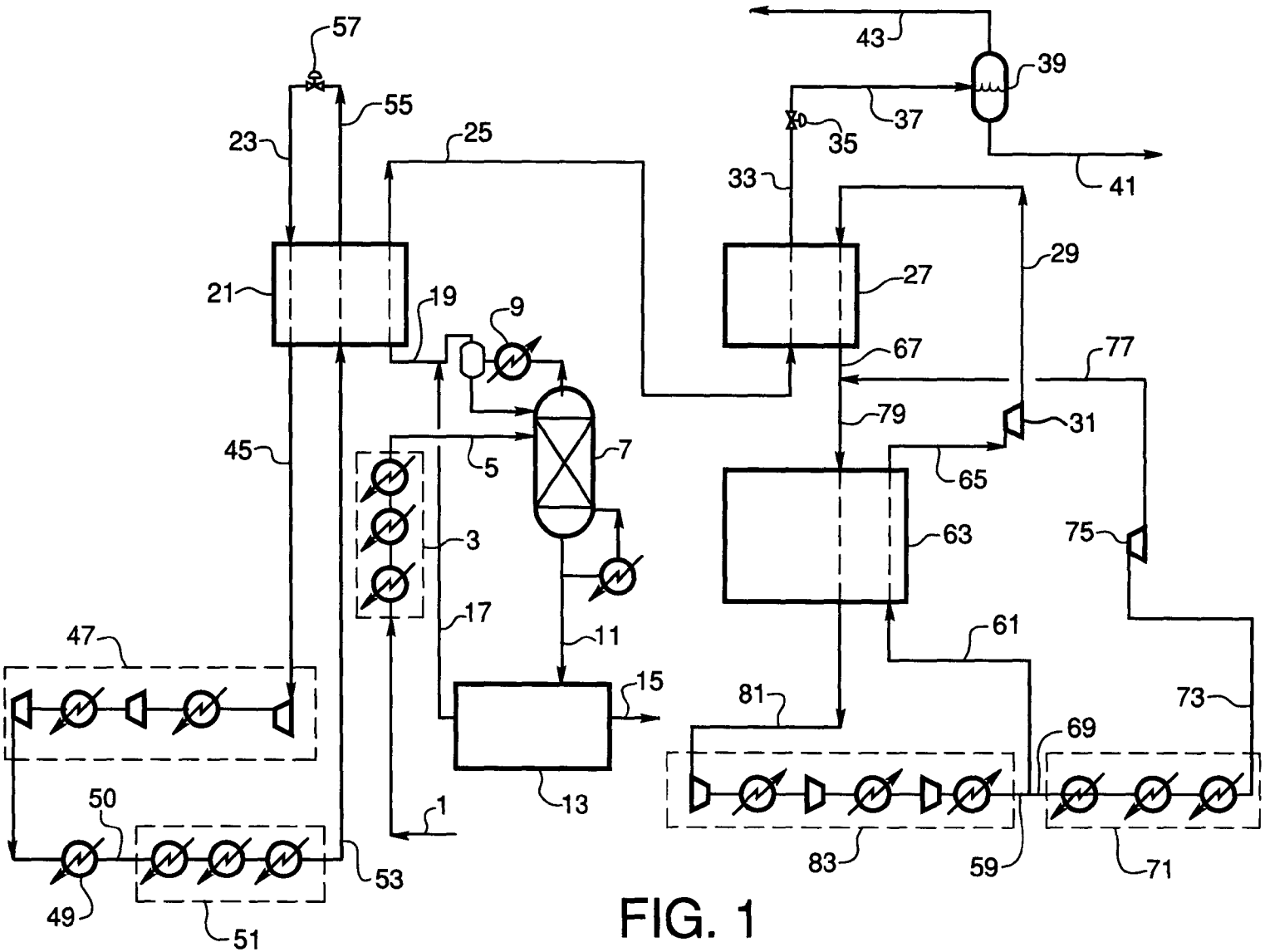
FIG. 1 is a schematic flowsheet of a gas liquefaction process according to an embodiment of the present invention utilizing two gas expanders with exhaust streams at similar pressures.

Embodiments of the invention utilize multiple expanders in a gas expansion refrigeration system for subcooling a feed gas which has been substantially liquefied, and may be used advantageously for subcooling a liquefied natural gas stream. The feed gas may be substantially liquefied by heat exchange with two or more refrigerant components or a multi-component refrigerant comprising two or more components in heat exchange equipment which is separate from the heat exchange equipment used for subcooling of the feed gas after it has been substantially liquefied. The use of separate heat exchange equipment for each duty allows optimum design of the gas expansion refrigeration system, which utilizes predominantly vapor refrigerant streams, and the vapor recompression refrigeration system, which utilizes one or more vaporizing refrigerant streams. Separate equipment items also may be advantageous in the case of a retrofit of the gas expansion refrigeration system into an existing gas liquefaction facility.

A refrigeration system is defined as one or more closed-loop refrigeration circuits or cycles; in each circuit or cycle a refrigerant is compressed, reduced in pressure, and warmed to provide refrigeration by indirect heat transfer to one or more process streams being cooled. The refrigerant may be a pure component or a mixture of two or more components. In a vapor recompression refrigeration circuit or cycle, refrigerant vapor is compressed, cooled, completely or nearly completely condensed, reduced in pressure, and vaporized to provide refrigeration, and the vapor is recompressed to complete the circuit or cycle. In a gas expansion refrigeration circuit or cycle, refrigerant gas is compressed, cooled, work expanded, warmed to provide refrigeration, and compressed to complete the circuit or cycle. The work-expanded refrigerant may be a single-phase gas or may be predominantly gas with a small amount of liquid; the work-expanded refrigerant may contain 0 to 20% liquid on a molar basis.

High thermodynamic efficiency in a refrigeration cycle is achieved when the warming and cooling curves of the fluids closely approach each other along their entire lengths. When the gas expander refrigeration system utilizes heat exchange equipment that is separate from the vaporizing refrigerant system heat exchange equipment, the flow of cooled high-pressure gas to the expander is the same as the flow of warm lower pressure gas returning from the expander. Due to the difference in heat capacities of the gas at the two pressure levels, the warming and cooling curves cannot be kept parallel over their entire length. To adjust for this difference, a refrigeration balance stream typically is taken between the liquefaction heat exchangers and that portion of the gas expansion heat exchangers which operate over the same temperature level. This increases the efficiency of the process by attaining more closely parallel warming and cooling curves, but has the disadvantage that the gas expansion and vapor recompression refrigeration systems are no longer independent.

Figure 2:
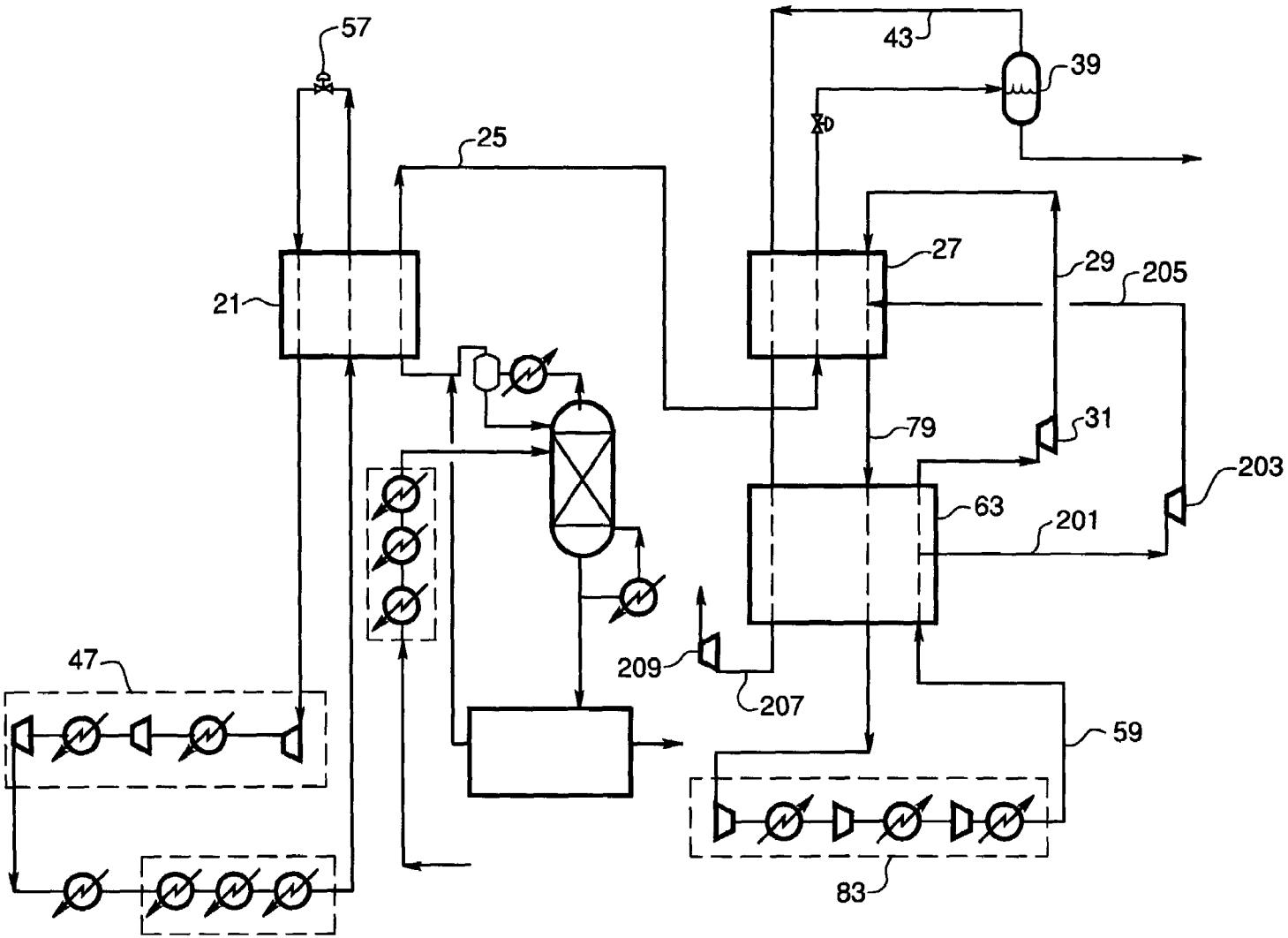
FIG. 2 is a schematic flowsheet of a gas liquefaction process according to another embodiment of the present invention utilizing two gas expanders with exhaust streams at similar pressures.

U.S. Pat. No. 6,308,531 cited earlier describes a liquefaction cycle in which cooling, liquefaction, and subcooling of a feed gas, preferably natural gas, is accomplished using two refrigeration systems. The warmer refrigeration system utilizes two cascaded vapor recompression cycles, such as a propane and a mixed refrigerant cycle or two mixed refrigerant cycles. The coldest refrigeration is provided by a gas expansion refrigeration system, preferably using nitrogen as the working fluid. FIG. 1 of U.S. Pat. No. 6,308,531 shows a single expander refrigeration system with a mixed refrigerant balance stream used in the warm gas expansion heat exchanger. FIG. 2 of that patent shows a portion of the high-pressure nitrogen gas being cooled in the mixed refrigerant heat exchangers as an alternative to achieve refrigeration balance in the gas expansion heat exchangers. The present invention allows for the complete separation of the gas expansion refrigeration system from the mixed refrigerant vapor recompression refrigeration circuit without sacrificing thermodynamic efficiency. This is achieved preferably by using two or more expanders in the gas expansion refrigeration system to reduce or eliminate the need for balance refrigeration between the mixed refrigerant heat exchangers and the gas expansion heat exchangers.

In the present disclosure, a refrigeration system is defined as a system comprising one or more refrigeration circuits used with one or more appropriate heat exchangers to cool one or more process streams by indirect heat exchange with one or more refrigerants provided by the one or more refrigeration circuits. A refrigeration circuit is a refrigerant loop in which a refrigerant gas is compressed, cooled, reduced in pressure, and warmed in a heat exchanger or heat exchangers to cool one or more process streams by indirect heat exchange. The warming refrigerant may be a single phase or a two-phase fluid. The warmed refrigerant gas is compressed to complete the circuit. A single refrigeration circuit may include a dedicated compressor or alternatively multiple refrigeration circuits may include a common compressor wherein the compressed refrigerant gas is divided and circulated through the multiple refrigeration circuits at different pressures. A heat exchanger is defined as a device which effects indirect heat exchange between one or more warming streams and one or more cooling streams wherein the warming and cooling streams are physically separated from each other. A heat exchange zone may comprise one or more heat exchangers or alternatively may comprise a section of a heat exchanger.

It has been found that a second expander can be placed in the gas expansion refrigeration system in such as way as to minimize and, in a preferred embodiment, eliminate the need for a balance stream without negative impact on the thermodynamic efficiency of the process. A second smaller expander is placed such that it takes relatively warm gas and expands it to an intermediate temperature level. This expanded intermediate-temperature stream is added to or supplements the returning lower pressure gas from the cold expander after the cold expanded gas has provided most of the LNG subcooling duty. The intermediate-temperature expanded gas replaces the mixed refrigerant balance stream in the warm gas expansion heat exchanger. A third expander can also be utilized in the gas expansion refrigeration system to further improve process efficiency. In general, the use of multiple expanders improves the efficiency of the gas expansion refrigeration system by providing a refrigerant warming curve closer to the refrigerant cooling curve than is possible with a single expander refrigerant warming curve.

In another embodiment, the pressurized refrigerant gas is precooled using a separate mixed refrigerant vapor recompression system and the warm expander is eliminated. This mixed refrigerant system is decoupled from the first refrigeration system which is used to provide the refrigeration required to cool and substantially liquefy the feed gas stream and also allows for the complete separation of the gas expansion refrigeration system from the first refrigeration system.

In one embodiment of the invention, multiple expanders are integrated into the gas expansion refrigeration system that provides refrigeration to subcool a feed gas which has been substantially liquefied by a first refrigeration system. This allows the gas expansion refrigeration system to be decoupled from the refrigeration system that provides the warmer refrigeration. The resulting equipment configuration increases the thermodynamic efficiency of the refrigeration cycle and enables optimum design of heat exchange equipment for each refrigeration system. The decoupling of the refrigeration systems also allows for a more efficient design when the gas expansion refrigeration system is added as part of a plant debottleneck or expansion.

The first refrigeration system, which provides at least a portion of the refrigeration required to substantially liquefy the feed gas, may utilize two or more refrigerant components in one or more refrigeration circuits or vapor recompression cycles. A second refrigeration system, which provides at least a portion of the refrigeration required to subcool the at least partially liquefied feed gas, utilizes work expansion of a pressurized refrigerant gas or gas mixture in at least two expanders. The multiple expanders generate refrigeration at more than one temperature level and the pressurized refrigerant gas is cooled prior to expansion in one or more heat exchangers or heat exchanger sections which do not cool the feed gas stream.

In an alternative embodiment of the invention, the pressurized refrigerant gas in the gas expansion refrigeration system is precooled using a separate third refrigeration system and only one expander is required. This separate third refrigeration system is decoupled from the first refrigeration system that provides the refrigeration required to cool and at least partially liquefy the feed gas stream, and this allows the complete segregation of the gas expansion refrigeration system from the first refrigeration system.

Any type of first refrigeration system utilizing one or more refrigerant components may be used to provide the high and mid-level refrigeration required to cool and substantially liquefy the feed gas stream. The one or more refrigerant components may be utilized in one or more refrigeration circuits or vapor recompression cycles. For example, the first refrigeration system may utilize only a vaporizing mixed refrigerant circuit comprising two or more refrigerant components. Optionally, the first refrigeration system also may include a second refrigeration circuit, which utilizes a vaporizing single component refrigerant or a vaporizing mixed refrigerant comprising two or more refrigerant components. Alternatively, the first and second refrigeration circuits of the first refrigeration system may utilize vaporizing single component refrigerants or vaporizing mixed refrigerants comprising two or more components or any combination of single and mixed refrigerants. Either or both refrigeration circuits can utilize refrigerants vaporizing at more than one pressure level and may include, for example, cascade refrigeration circuits. The process is independent of the configuration of the first refrigeration system that is used to provide the refrigeration required to cool and substantially liquefy the feed gas stream.

The refrigerant in the first refrigeration system may comprise one or more components selected from the group consisting of nitrogen, hydrocarbons containing one or more carbon atoms, and halocarbons containing one or more carbon atoms. Typical hydrocarbon refrigerants include methane, ethane, isopropane, propane, isobutane, butane, pentane, and isopentane. Representative halocarbon refrigerants include R22, R23, R32, R134a and R410a. The refrigerant in the second refrigeration system, i.e., the gas expansion system, may be a pure component or a mixture of components selected from the group consisting of nitrogen, argon, methane, ethane, and propane.

The process can be used to liquefy any feed gas stream and is illustrated for the liquefaction of natural gas in FIG. 1. Natural gas feed in line 1, which has been cleaned and dried in a pretreatment section (not shown) for the removal of acid gases such as $CO_2$ and $H_2S$, and the removal of other contaminants such as mercury, enters optional precooling heat exchanger section 3 and is cooled to an intermediate temperature of about −10° C. to −30° C. using a vaporizing refrigerant such as propane or a mixed refrigerant. The vaporizing refrigerant is provided by a recirculating refrigeration circuit (not shown) of any type known in the art.

Precooled natural gas feed stream 5 enters scrub column 7 where the heavier components of the feed, such as pentane and heavier hydrocarbons, are removed to prevent subsequent freezing in the liquefaction process. The scrub column has an overhead condenser 9 which also may use a refrigerant such as propane or a mixed refrigerant to provide reflux to the scrub column. The bottoms product from the scrub column in line 11 is sent to a fractionation section 13 where the heavy components are separated and recovered via line 15 and the lighter components in line 17 are recombined with the overhead vapor product of the scrub column to form purified natural gas in line 19. The light component in line 17 may be either a vapor stream or a liquid stream and preferably is precooled to approximately the same temperature as the overhead vapor stream from scrub column 7.

Purified natural gas in line 19 is further cooled to a temperature below −50° C., preferably between about −100° C. and −120° C., and preferably is substantially liquefied in first heat exchange zone or mixed refrigerant heat exchanger 21 by indirect heat exchange with a warming and vaporizing intermediate temperature mixed refrigerant provided via line 23. The term "substantially liquefied" as used herein means that a substantially liquefied stream, when expanded adiabatically by throttling to atmospheric pressure, will have a liquid fraction between 0.25 and 1.0 and preferably between 0.5 and 1.0. A liquid fraction of 1.0 defines a totally liquefied or condensed stream, wherein the liquid may be either saturated or subcooled, and a liquid fraction of zero defines a stream that is totally vapor and contains no liquid. A substantially liquefied stream as defined here may be at any pressure including a pressure above the critical pressure of the stream.

Substantially liquefied natural gas in line 25 is further cooled to a temperature of about −120° C. to −160° C. in second heat exchange zone or heat exchanger 27 by indirect heat exchange with a cold work-expanded refrigerant in line 29 provided by expander 31. This cold refrigerant, typically nitrogen, is predominately vapor with typically less than about 20% liquid (molar basis) at a pressure of about 15 to 30 bara and a temperature of about −122° C. to −162° C.

The resulting further cooled and substantially liquefied natural gas in line 33 may be above, at, or below its critical pressure, and may be a subcooled liquid if it is below its critical pressure. The further cooled and substantially liquefied natural gas in line 33 may be flashed adiabatically to a pressure of about 1.05 to 1.2 bara across throttling valve 35. Alternatively, the pressure of the subcooled LNG in line 33 could be reduced using a dense-fluid expander, or a combination of expander and valve. The low-pressure LNG in line 37 flows to separator or storage tank 39 with the LNG product exiting in line 41. In some cases, depending on the natural gas composition and the LNG temperature exiting heat exchanger 27, a significant quantity of light gas in line 43 is evolved after the flash across valve 35. In these cases, the flash gas in line 43 may be warmed and compressed to a pressure sufficient for use as fuel gas in the LNG facility or other use.

Refrigeration to cool and substantially liquefy the natural gas feed stream 1 is provided by the intermediate temperature mixed refrigerant circuit in heat exchanger 21 and, in this example, by a second refrigerant such as propane or a second mixed refrigerant in a second refrigeration circuit which provides refrigeration at higher temperatures in precooling heat exchanger section 3. Refrigerant in line 23 is warmed and vaporized in heat exchanger 21 to provide refrigeration therein and exits as refrigerant vapor in line 45. This refrigerant vapor is compressed to a suitable high pressure in multi-stage, inter-cooled in compressor 47, cooled in ambient aftercooler 49, and further cooled and either partially or fully condensed in heat exchanger section 51 by indirect heat exchange with an additional vaporizing refrigerant such as propane or a mixed refrigerant. This vaporizing refrigerant is provided by a recirculating refrigeration circuit (not shown) of any type known in the art, and may be the same recirculating refrigeration circuit providing refrigeration to heat exchanger section 3 described earlier.

The precooled high-pressure mixed refrigerant in line 53 enters mixed refrigerant heat exchanger 21 at an intermediate temperature of about −20° C. to −40° C. and a pressure of about 50 to 70 bara. The high-pressure mixed refrigerant is cooled to a temperature of about −100° C. to −120° C. and preferably is totally condensed in heat exchanger 21, exiting in line 55. The condensed high-pressure mixed refrigerant stream in line 55 is flashed across valve 57 (or alternatively by a dense-phase expander) to a pressure of about 3 to 6 bara and flows to the cold end of heat exchanger 21 in line 23. The low-pressure mixed refrigerant stream is warmed and vaporized in heat exchanger 21, exiting as warmed mixed refrigerant in line 45.

Cooling of the natural gas feed in line 1 to provide the cooled and substantially liquefied natural gas in line 25 as described above thus is provided by a first refrigeration system which comprises the intermediate temperature mixed refrigerant circuit that provides refrigeration to heat exchanger 21, the refrigeration circuit that provides the second refrigerant such as propane or another mixed refrigerant to the feed precooling heat exchanger section 3, and the refrigeration circuit that provides the third refrigerant such as propane or another mixed refrigerant to heat exchanger section 51. As described above, the same refrigeration circuit may provide both the second and third refrigerants.

Further cooling of the substantially liquefied natural gas in line 25 is accomplished by a multi-expander gas expansion system that utilizes a refrigerant comprising one or more gases selected from the group consisting of nitrogen, argon, methane, ethane, and propane. In this illustration, nitrogen is used as the refrigerant. High-pressure nitrogen in line 59 at ambient temperature and about 50 to 80 bara is divided into two portions. The larger portion in line 61 enters third heat exchange zone or warm gas expansion heat exchanger 63 and is cooled to a temperature of about −100° C. to −120° C. The cooled high-pressure nitrogen in line 65 is work-expanded in cold expander 31, exiting at a pressure of about 15 to 30 bara and a temperature of about −152° C. to −162° C. Typically, the expander discharge pressure is at or close to the dew point pressure of the nitrogen at a temperature cold enough to provide the desired level of subcooling of the LNG in line 33. The work-expanded refrigerant may contain up to about 20% liquid (molar basis). The cold work-expanded nitrogen stream in line 29 is warmed in cold gas expansion heat exchanger 27 to provide the cold refrigeration required to subcool the LNG stream in line 33, and intermediate warmed nitrogen leaves the exchanger in line 67.

The smaller high-pressure nitrogen stream in line 69 may be precooled to an intermediate temperature of about −20° C. to −40° C. with a refrigerant such as propane or a second mixed refrigerant in heat exchanger section 71. The precooled high-pressure nitrogen stream in line 73 is work-expanded in warm expander 75 and is discharged at a pressure of about 15 to 30 bara and a temperature of about −90° C. to −110° C. The work-expanded refrigerant stream in line 77 is combined with the warmed nitrogen stream in line 67 from cold heat exchanger 27 and the combined stream flows via line 79 to warm heat exchanger 63. The combined nitrogen stream is warmed to ambient temperature in warm heat exchanger 63, is withdrawn via line 81, and is compressed to a suitable high pressure in multi-stage, intercooled compressor 83 to provide high-pressure nitrogen stream 59 for recycle. The addition of the smaller expanded nitrogen stream 77 for warming in heat exchanger 63 maintains the cooling curves in warm gas expansion heat exchanger 63 at close to ideal, that is, the warming and cooling curves of the fluids closely approach each other along their entire lengths.

All or a portion of the high-pressure nitrogen in line 59 could be precooled with propane or other high-level refrigerant as an alternative to precooling the portion entering cold expander 31 in warm heat exchanger 63 and to precooling the portion entering warm expander 25 with propane or other refrigerant in heat exchange section 71. Alternatively, the gas expansion refrigeration system may be operated without any precooling of the compressed nitrogen prior to heat exchanger 63 and expander 75. These options for gas expansion system refrigerant precooling apply to any embodiment of the invention.

The warm and cold gas expansion heat exchangers 63 and 27 may be combined into a single unit, and may be of any suitable type, such as plate-fin, wound-coil, or shell and tube construction, or any combination thereof. Similarly, the mixed refrigerant heat exchanger 21 and the optional precooling heat exchangers in sections 3, 51, and 71 may consist of single or multiple heat exchangers and may be of any suitable construction. These heat exchanger options also apply to any embodiment of the invention. The invention is independent of the number and arrangement of the heat exchangers utilized in the claimed process.

If the high-pressure mixed refrigerant in line 53 is a two-phase mixture, the vapor and liquid fractions may be cooled separately in the mixed refrigerant heat exchanger 21 and vaporized either separately at the same or different pressure levels or as a combined stream in heat exchanger 21. The mixed refrigerant also may be divided into two or more streams which may be vaporized at different pressure levels. The mixed refrigerant may be divided by one or more equilibrium (vapor/liquid) separations or by one or more single-phase splits or any combination thereof. These mixed refrigerant options may be used in any of the refrigeration circuits of the first refrigeration system and also apply to any embodiment of the invention. The invention is independent of the configuration of the first refrigeration system that is used to provide the refrigeration required to cool and substantially liquefy the feed gas stream.

Typically, at least 40% of the total refrigeration duty to convert the natural gas feed in line 1 into the LNG product in line 41 is provided by the first refrigeration system. In the embodiment of FIG. 1, this refrigeration is provided in heat exchanger section 3, heat exchanger section 51, and heat exchanger 21.

A feature of the embodiment illustrated in FIG. 1 is that the first refrigeration system, i.e., the system comprising compressor 47, heat exchanger 21, and expansion valve 57, may operate independently of the second refrigeration system, i.e., the system comprising compressor 83, heat exchangers 27 and 63, and expanders 31 and 75. Independent operation means that no heat is exchanged between the mixed refrigerant in the first refrigeration system and the nitrogen refrigerant in the second refrigeration system, and no balance refrigeration is needed between the two refrigeration systems.

Another feature is that the flow rate of work-expanded nitrogen via line 29 in second heat exchange zone 27 typically is less than the flow rate work-expanded nitrogen stream 79 in third heat exchange zone 63. No cooling of the feed gas or the cooled feed stream occurs in third heat exchange zone 63. In addition, the flow rate of compressed nitrogen in line 61 being cooled in third heat exchange zone 63 typically is less than the flow rate of combined work-expanded nitrogen in line 79 being warmed in third heat exchange zone 63.

An alternative embodiment of the invention is illustrated in FIG. 2. In this alternative embodiment, all of the high-pressure nitrogen refrigerant in line 59 from compressor 83 is precooled in warm gas expansion heat exchanger 63, and none of this high-pressure nitrogen is cooled with a refrigerant such as propane in heat exchange section 71 of FIG. 1. A smaller portion of the partially-cooled nitrogen refrigerant in heat exchanger 63 is withdrawn at an intermediate point via line 201 and is work expanded in expander 203 to provide work-expanded nitrogen in line 205. Expanded nitrogen in line 205 preferably is mixed with the partially warmed expanded nitrogen stream at an intermediate point in heat exchanger 27 at a temperature somewhat below that of the incoming substantially liquefied natural gas in line 25.

Alternatively, high-pressure nitrogen in line 59 may be split into two portions (not shown) which are cooled separately in heat exchanger 63. Either or both of heat exchangers 27 and 63 may be split into two heat exchangers if desired. The cooling of high-pressure nitrogen in line 201 also may be accomplished by a combination of cooling in warm heat exchanger 63 and cooling with another high-level refrigerant such as propane.

In this example, the LNG flash gas in line 43 from separator 39 is warmed in gas exchangers 27 and 63, exiting via line 207 and is compressed in flash gas compressor 209 to a pressure sufficient for use as fuel gas in the LNG facility or for other use. However, warming of the flash gas in heat exchangers 27 and 63 is optional and is not required in any embodiment of the invention.

A feature of the embodiment illustrated in FIG. 2 is that the first refrigeration system, i.e., the system comprising compressor 47, heat exchanger 21, and expansion valve 57, operates independently of the second refrigeration system, i.e., the system comprising compressor 83, heat exchangers 27 and 63, and expanders 31 and 203. Independent operation means that no heat is exchanged between the mixed refrigerant in the first refrigeration system and the nitrogen refrigerant in the second refrigeration system. No balance refrigeration is needed between the two refrigeration systems in this embodiment.

Another feature is that the flow rate of work-expanded nitrogen via line 29 in second heat exchange zone 27 prior to the combination with expanded nitrogen in line 205 may be less than the flow rate of combined work-expanded nitrogen stream 79 in third heat exchange zone 63. No cooling of the feed gas or the cooled feed stream occurs in third heat exchange zone 63. In addition, the flow rate of compressed nitrogen being cooled in third heat exchange zone 63 after withdrawal of nitrogen via line 201 may be less than the flow rate of combined work-expanded nitrogen in line 79 being warmed in third heat exchange zone 63.

Figure 3:
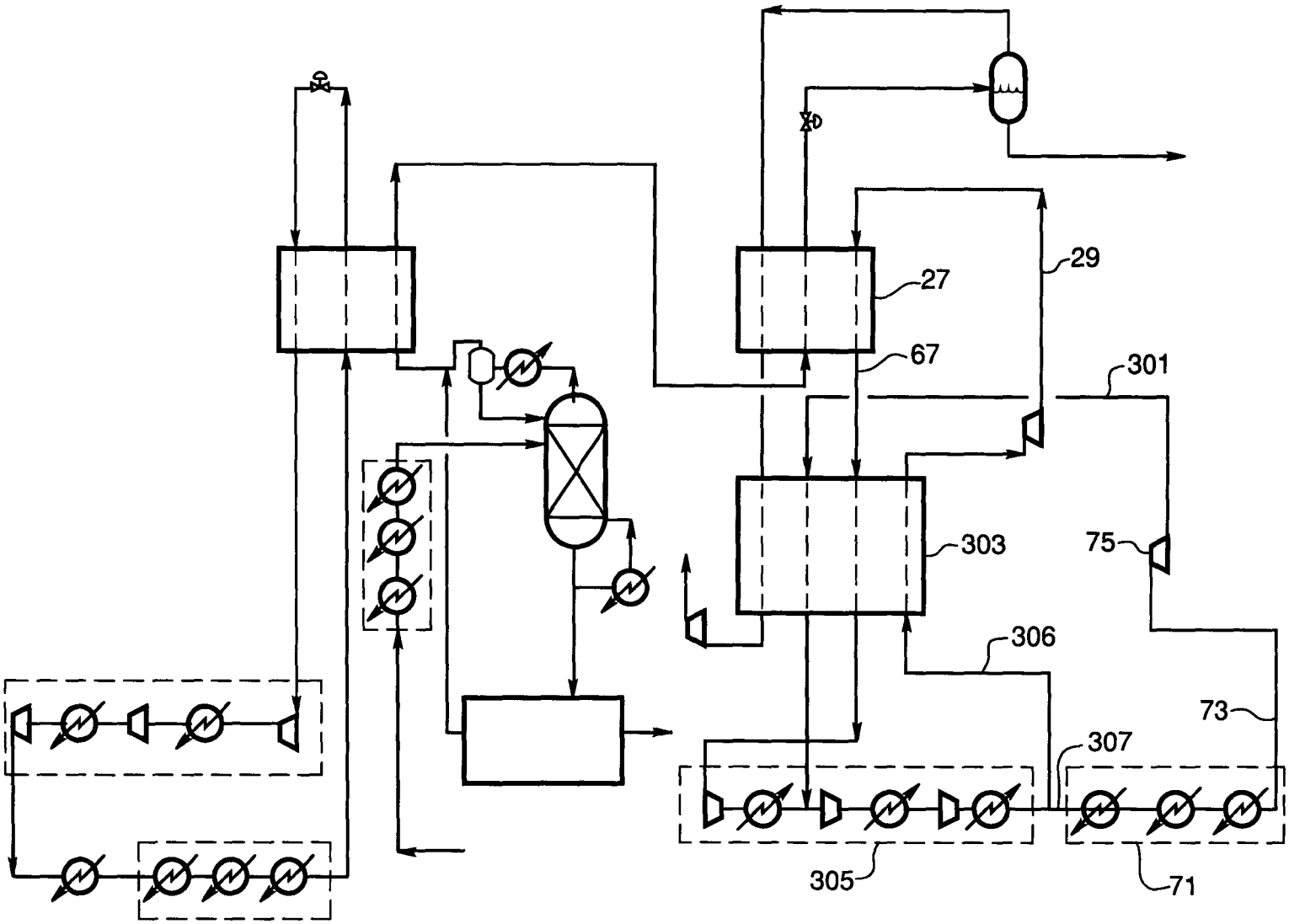
FIG. 3 is a schematic flowsheet of a gas liquefaction process according to another embodiment of the present invention utilizing two gas expanders with exhaust streams at different pressures.

Another embodiment of the invention is illustrated in FIG. 3 and is a modification of the embodiments of FIGS. 1 and 2. The precooled high-pressure nitrogen in line 73 is expanded in warm expander 75 to an intermediate pressure, e.g., 25 to 45 bara. The intermediate-pressure expanded nitrogen in line 301 is warmed separately in warm gas expansion heat exchanger 303 and flows to an intermediate stage of multi-stage compressor 305 to reduce power requirements. An alternative of this embodiment is to withdraw stream 307 from an intermediate stage of compressor 305 at an intermediate pressure, cool it in heat exchange section 71, expand the cooled stream in line 73 to the lower pressure level in expander 75, and combine the lower pressure expanded stream in line 301 with intermediate warm refrigerant in line 67 for warming in warm gas expansion heat exchanger 303, as in FIG. 1. In either alternative, the high or intermediate-pressure nitrogen stream in line 307 may be cooled either with a high-level refrigerant such as propane in heat exchanger section 71, as shown, or in warm heat exchanger 303, or a combination of both.

A feature of the embodiment illustrated in FIG. 3 is that the flow rate of work-expanded nitrogen via line 29 in second heat exchange zone 27 typically is less than the total flow rate work-expanded nitrogen streams 67 and 301 in third heat exchange zone 303. Typically, no cooling of the feed gas or the cooled feed stream occurs in third heat exchange zone 303. In addition, the flow rate of compressed nitrogen in line 306 being cooled in third heat exchange zone 303 typically is less than the total flow rate of work-expanded nitrogen in lines 67 and 301 being warmed in third heat exchange zone 303.

Figure 4:
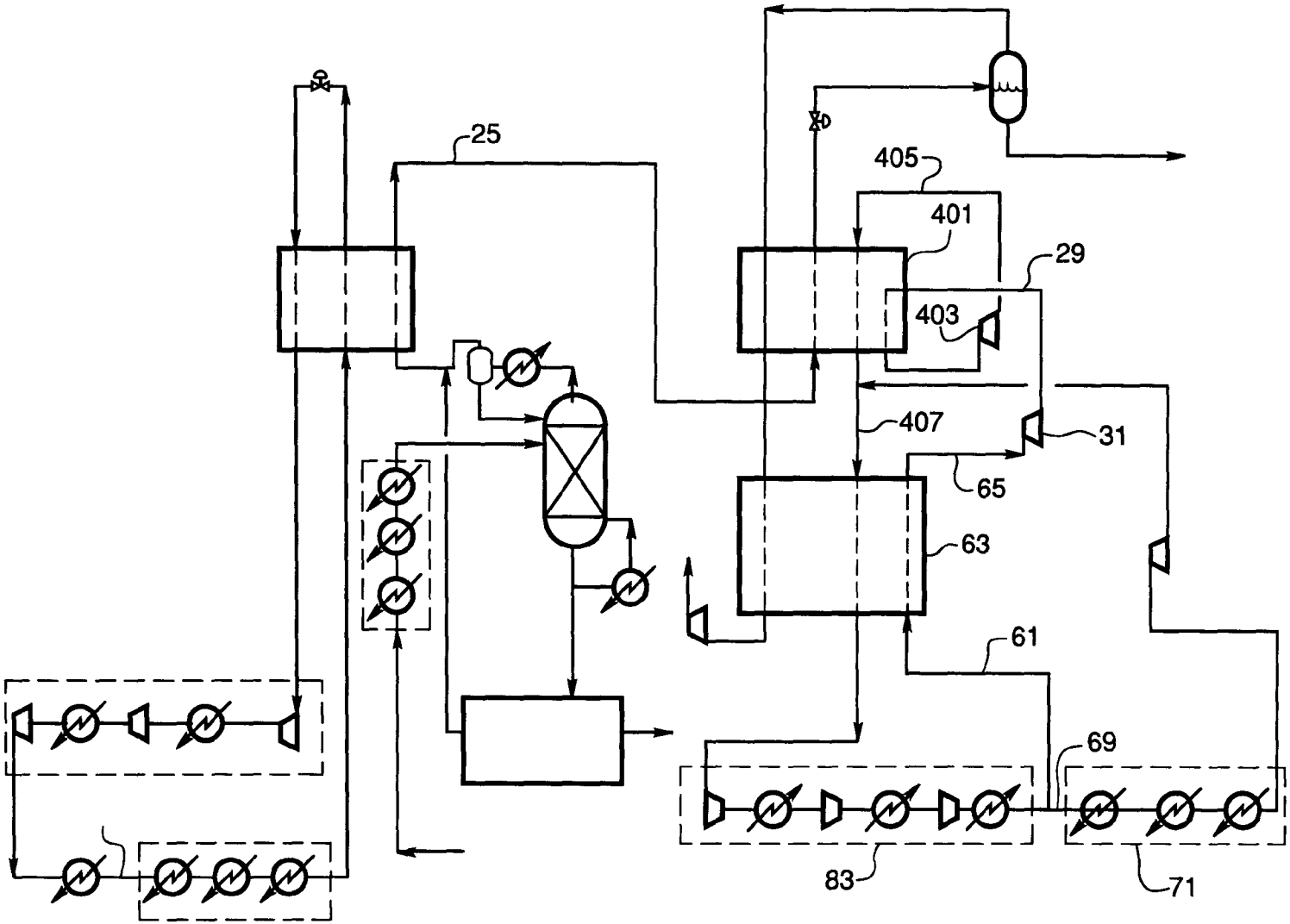
FIG. 4 is a schematic flowsheet of a gas liquefaction process according to another embodiment of the present invention utilizing three gas expanders with exhaust streams at similar pressures.

FIG. 4 illustrates an alternative embodiment of FIG. 1 wherein the cooled high-pressure nitrogen stream in line 65 is work expanded in two stages. The stream is expanded first in intermediate expander 31 to an intermediate pressure, e.g., 25 to 45 bara, and to a temperature below that of the incoming substantially liquefied natural gas stream in line 25. The intermediate-pressure expanded stream in line 29 preferably is warmed in cold gas expansion heat exchanger 401 to provide refrigeration therein, and then is further expanded in cold expander 403 to a lower pressure, e.g., 15 to 30 bara. The lower pressure expanded nitrogen stream in line 405 then provides the coldest level of refrigeration in cold heat exchanger 401 to subcool the incoming substantially liquefied natural gas stream in line 25.

A portion of the intermediate-pressure expanded nitrogen stream in line 405, preferably after warming in cold heat exchanger 401, may be warmed separately (not shown) in warm heat exchanger 63 and sent to an intermediate stage of the multi-stage compressor 83. As in the embodiment of FIG. 3, the high-pressure nitrogen stream in line 69 may be precooled either with a high-level refrigerant such as propane in heat exchanger section 71, as shown, or in warm heat exchanger 63, or a combination of both.

The addition of an intermediate expander in this embodiment provides refrigeration at higher thermodynamic efficiency in the cold gas expansion heat exchanger 401. The warming and cooling curves of the fluids in this exchanger approach each other more closely along their entire lengths, which is advantageous, but this requires another piece of equipment, i.e., expander 403, in the system.

A feature of the embodiment illustrated in FIG. 4 is that the flow rate of work-expanded nitrogen via line 405 in second heat exchange zone 27 typically is less than the flow rate work-expanded nitrogen stream 407 in third heat exchange zone 63. No cooling of the feed gas or the cooled feed stream occurs in third heat exchange zone 63. In addition, the flow rate of compressed nitrogen in line 61 being cooled in third heat exchange zone 63 typically is less than the flow rate of work-expanded nitrogen in line 407 being warmed in third heat exchange zone 63.

Figure 5:
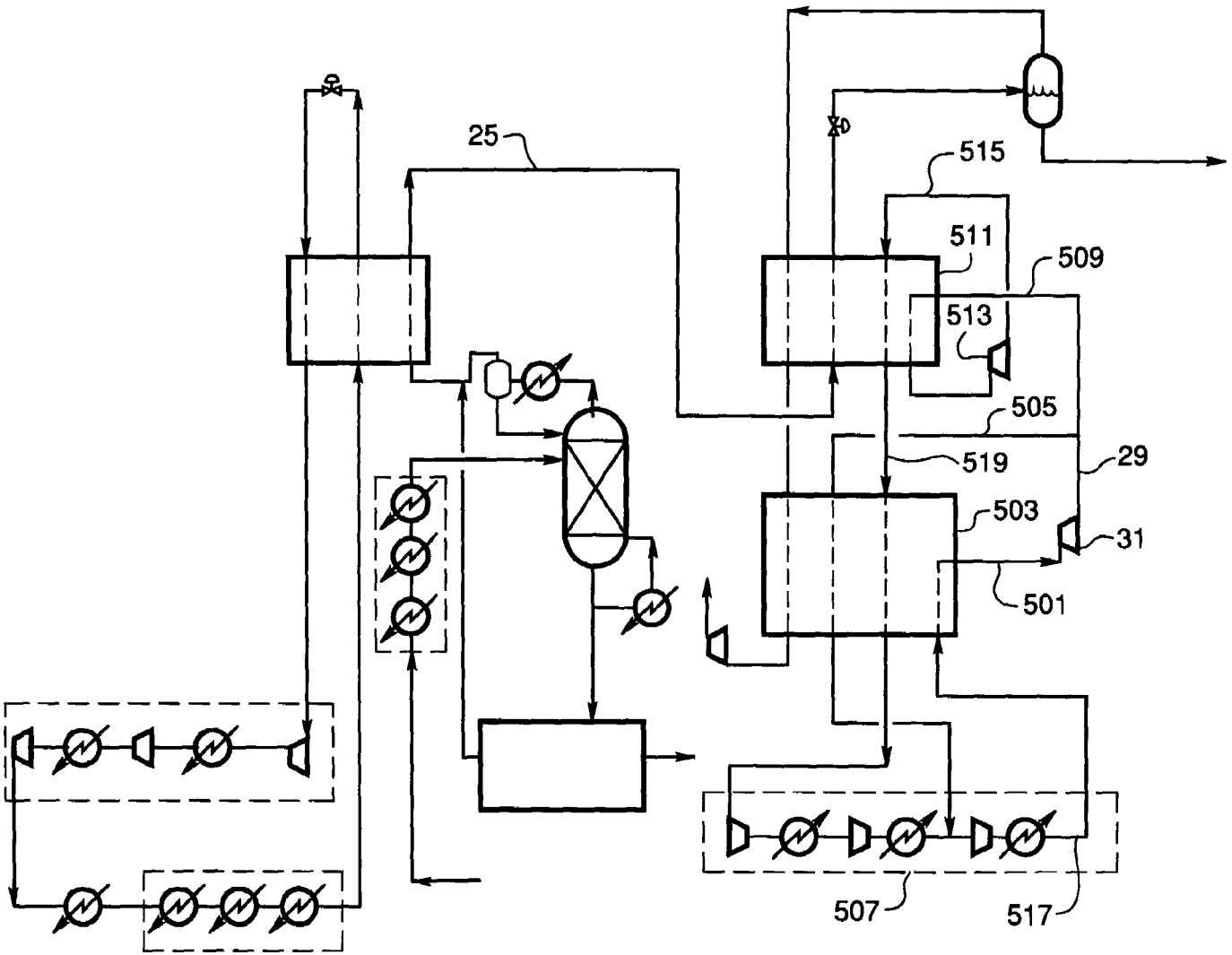
FIG. 5 is a schematic flowsheet of a gas liquefaction process according to another embodiment of the present invention utilizing two gas expanders with exhaust streams at different pressures.

Another embodiment of the invention is illustrated in FIG. 5 in which the gas expansion refrigeration system utilizes two stages of expansion. Precooled high-pressure nitrogen stream in line 501 is withdrawn from an intermediate point in warm heat exchanger 503 and is expanded in warm expander 31 to an intermediate pressure, e.g., 25 to 45 bara, and to a temperature below that of the incoming natural gas stream in line 25. A portion of the intermediate-pressure expanded nitrogen stream in line 29 is withdrawn via line 505, warmed separately in warm gas expansion heat exchanger 503, and sent to an intermediate stage of the multi-stage compressor 507 to reduce power requirements.

The remaining intermediate-pressure nitrogen in line 509, preferably after reheat in cold gas expansion heat exchanger 511, is further expanded in cold expander 513 to a lower pressure, e.g., 15 to 30 bara. The lower pressure expanded nitrogen stream in line 515 then provides the coldest level of refrigeration in cold gas expansion heat exchanger 511 which is required to subcool incoming substantially liquefied natural gas stream in line 25. The warm high-pressure nitrogen stream in line 517 optionally may be precooled either in warm heat exchanger 503, as shown, or with a high-level refrigerant such as propane, or a combination of both.

A feature of the embodiment illustrated in FIG. 5 is that the flow rate of work-expanded nitrogen via line 515 in second heat exchange zone 511 typically is less than the total flow rate of work-expanded nitrogen streams in lines 505 and 519 in third heat exchange zone 503. Preferably, no cooling of the feed gas or the cooled feed stream occurs in third heat exchange zone 503.

Other embodiments of the invention may utilize an integrated balance stream between the gas expansion refrigeration heat exchangers and the mixed refrigerant heat exchangers in order to achieve a more thermodynamically efficient integration of the two refrigeration systems. These embodiments, which also utilize multiple expanders, may provide a more efficient design for debottlenecking or expanding an existing gas liquefaction facility.

Figure 6:
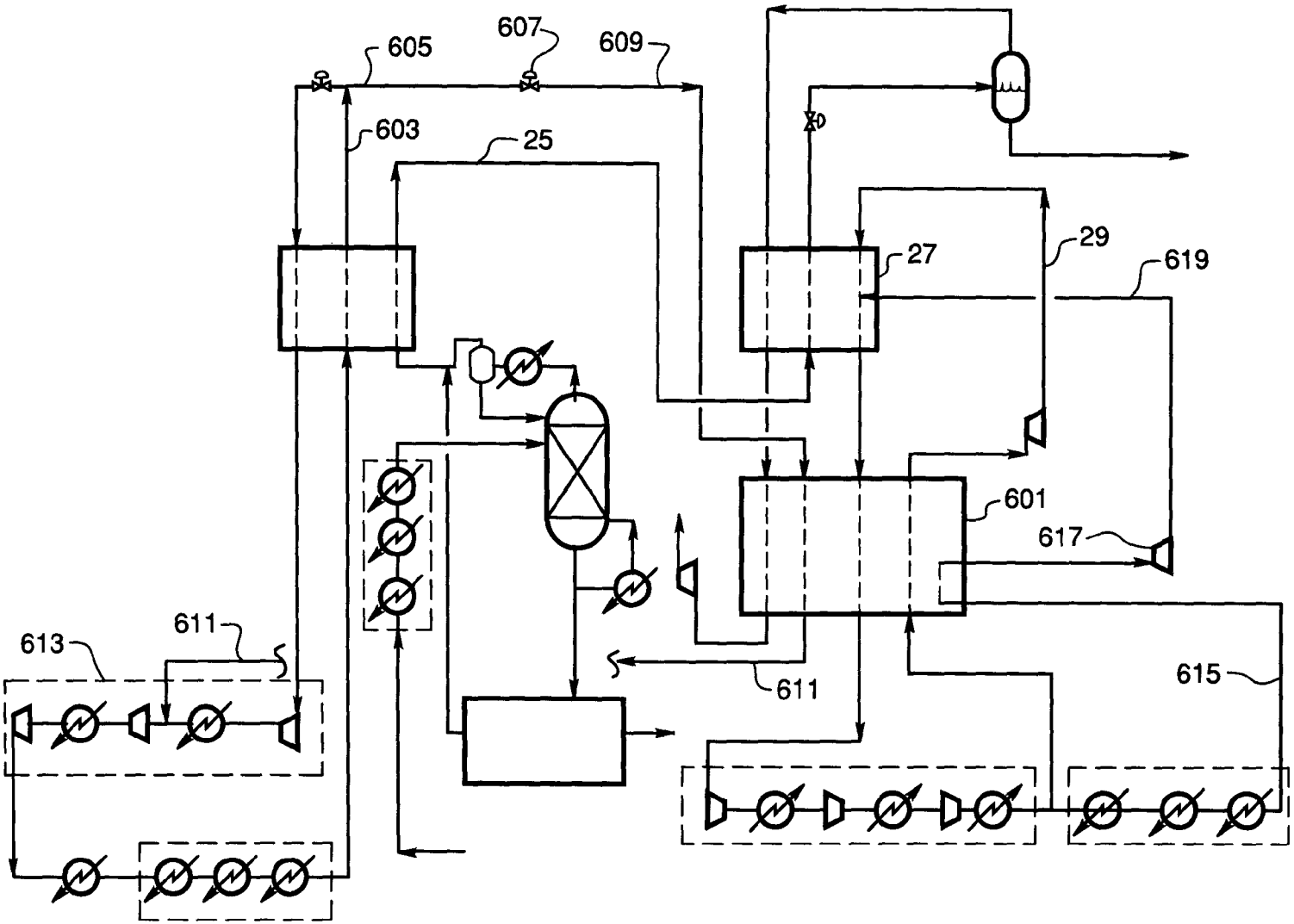
FIG. 6 is a schematic flowsheet of a gas liquefaction process according to another embodiment of the present invention utilizing two gas expanders with exhaust streams at similar pressures and a balance refrigeration stream.

FIG. 6 illustrates a multiple-expander gas expansion refrigeration system with a mixed refrigerant balance stream used in the warm gas expansion heat exchanger 601. A small portion of high-pressure mixed refrigerant in line 603 is withdrawn via line 605 and flashed to an intermediate pressure across valve 607. The resulting intermediate-pressure mixed refrigerant stream in line 609, typically at −90 to −110° C. and 5 to 10 bara, is warmed in warm gas expansion heat exchanger 601 to provide more closely parallel warming and cooling curves in that heat exchanger and thereby increase the efficiency of the process. The warmed mixed refrigerant stream 611 at near ambient temperature is returned to an intermediate stage of multi-stage mixed refrigerant compressor 613 for recycle. Alternatively, the condensed high-pressure mixed refrigerant balance stream in line 605 may be flashed to the lowest pressure level of the mixed refrigerant circuit, e.g., 3 to 6 bara, warmed to an intermediate temperature in warm heat exchanger 601, e.g., −20 to −40° C., and returned to the first stage of the mixed refrigerant compressor 613.

In the gas expansion refrigeration system of this embodiment, the precooled smaller portion of the high-pressure nitrogen stream in line 615 preferably is further cooled in warm heat exchanger 601 to a temperature below that of the propane or other high-level refrigerant prior to work-expansion in warm expander 617. The expanded intermediate-temperature nitrogen stream in line 619 is preferably mixed with the partially warmed cold nitrogen stream in line 29 at an intermediate point in cold gas expansion heat exchanger 27 at a temperature below that of the incoming substantially liquefied natural gas stream 25. Either or both gas expansion heat exchangers 27 and 601 may be split into two or more heat exchangers if desired.

Figure 7:
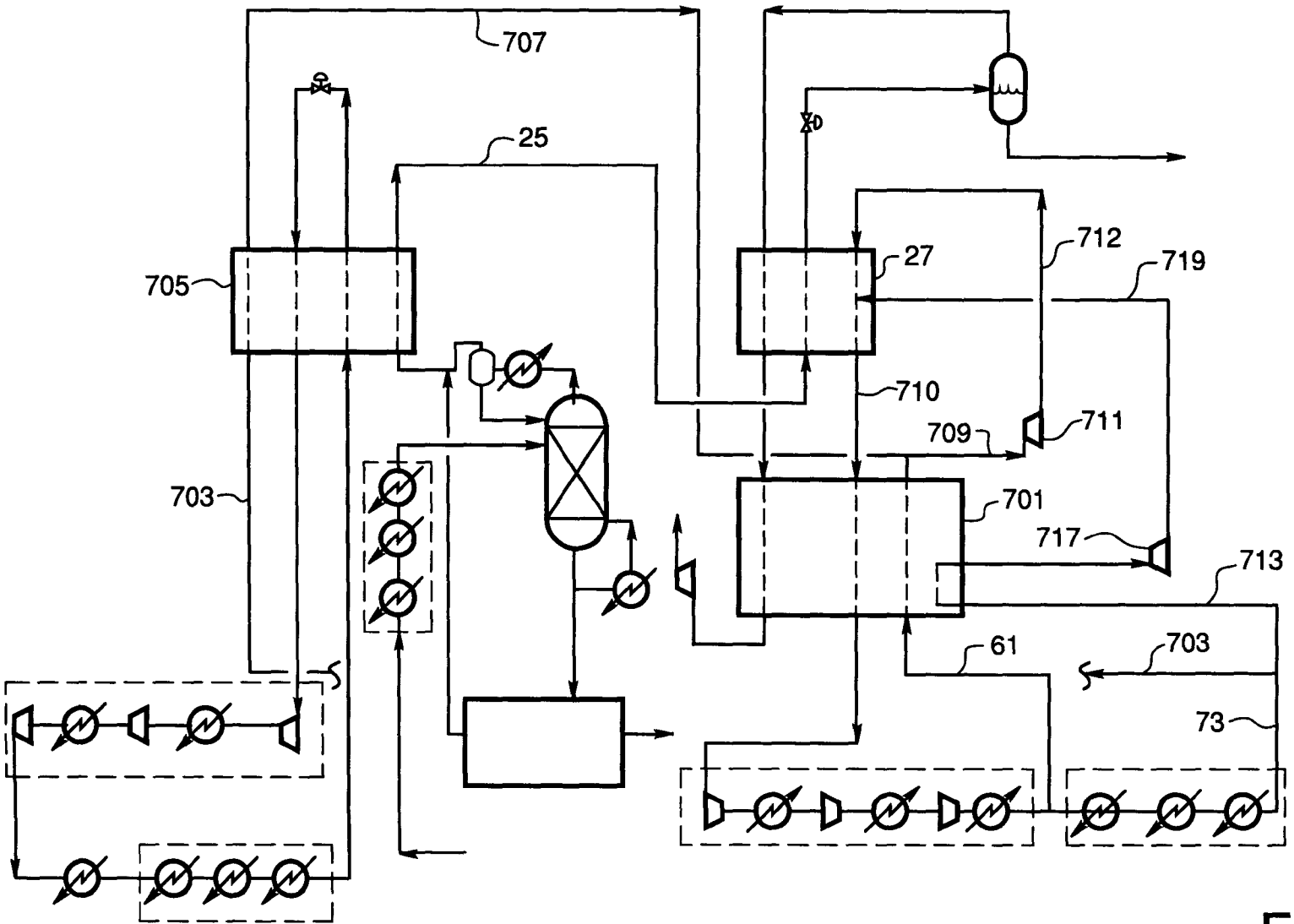
FIG. 7 is a schematic flowsheet of a gas liquefaction process according to another embodiment of the present invention utilizing two gas expanders with exhaust streams at similar pressures and a balance refrigeration stream.

FIG. 7 illustrates an alternative multiple-expander gas expansion refrigeration system wherein a portion of the high-pressure nitrogen gas is cooled in mixed refrigerant heat exchanger 705 as an alternative way to achieve a more efficient refrigeration balance in the warm gas expansion heat exchanger 701. A portion of the precooled high-pressure nitrogen stream in line 73 at about −20 to −40° C. is withdrawn via line 703 and is further cooled to about −100 to −120° C. in mixed refrigerant heat exchanger 705. The cooled high-pressure nitrogen stream in line 707 is mixed with the portion of the high-pressure nitrogen stream 61 after cooling in warm heat exchanger 701 and the combined stream in line 709 flows to the inlet of cold expander 711.

In the gas expansion refrigeration system of this embodiment, the remaining portion of the precooled high-pressure nitrogen stream in line 713 preferably is further cooled in warm heat exchanger 701 to a temperature below that of the propane or other high-level refrigerant prior to work expansion in warm expander 717. The intermediate-temperature nitrogen stream in line 719 preferably is mixed with the partially-warmed cold nitrogen stream at an intermediate point in cold gas expansion heat exchanger 27 at a temperature below that of the incoming substantially liquefied natural gas stream in line 25. Either or both gas expansion heat exchangers 27 and 701 can also be split into two or more heat exchangers if desired.

A feature of this embodiment is that the flow rate of work-expanded nitrogen via line 712 in second heat exchange zone 27 prior to the combination with expanded nitrogen in line 719 is less than the flow rate of combined work-expanded nitrogen stream 710 in third heat exchange zone 701. No cooling of the feed gas or the cooled feed stream occurs in third heat exchange zone 63. In addition, the flow rate of either of compressed nitrogen streams 61 and 713 being cooled in heat exchanger 701 is less than the flow rate of work-expanded nitrogen in line 710 being warmed in heat exchanger 701.

Figure 8:
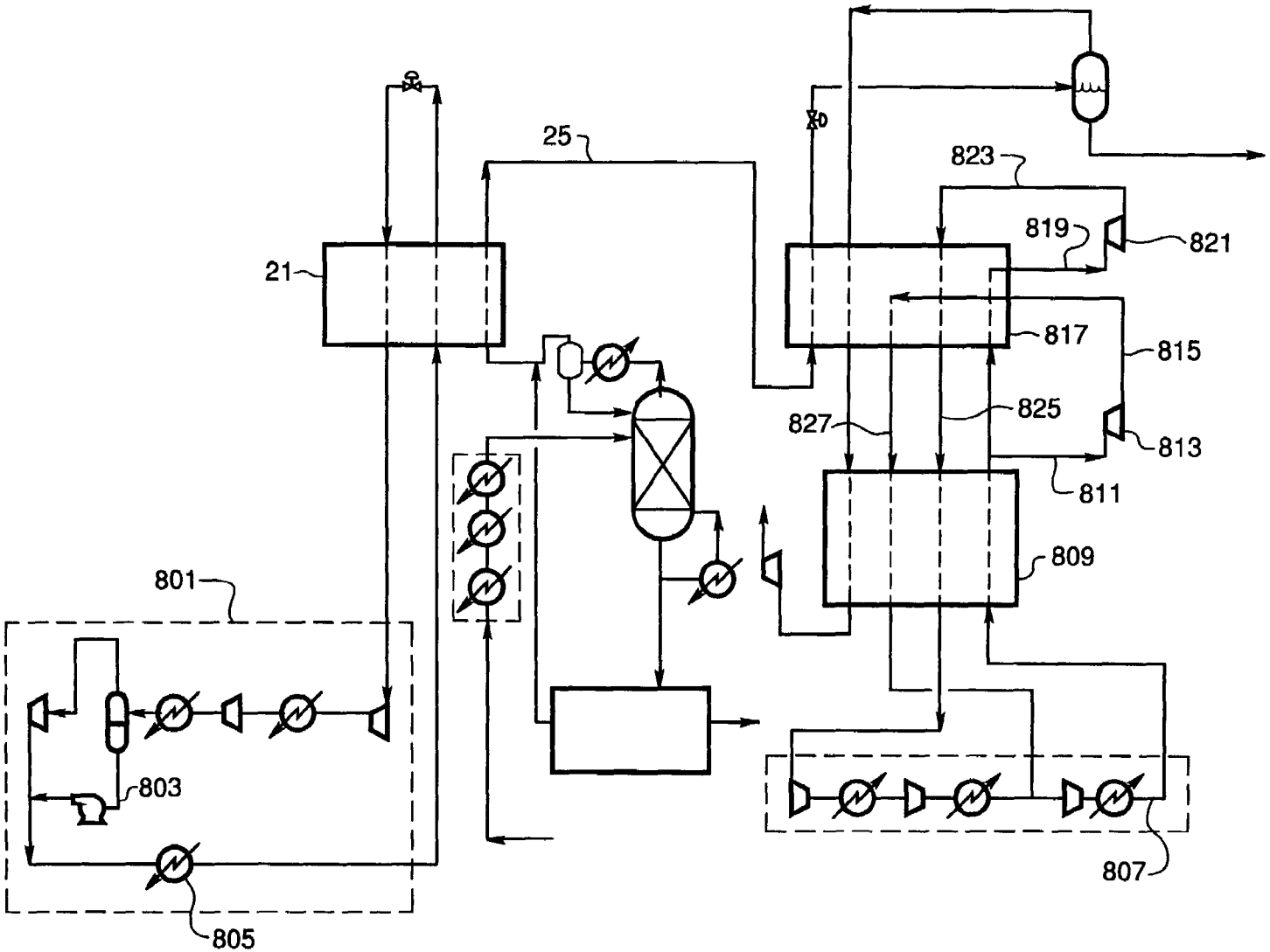
FIG. 8 is a schematic flowsheet of a gas liquefaction process according to another embodiment of the present invention utilizing two gas expanders with exhaust streams at different pressures.

FIG. 8 shows a single mixed refrigerant refrigeration system combined with a multiple-expander gas expansion refrigeration system which operate without the additional external refrigeration, for example propane, as shown in the embodiments of FIGS. 1–7. Refrigerant in the single mixed refrigeration system is not precooled below ambient temperature, e.g., by propane or another high level mixed refrigerant, prior to entering the mixed refrigerant heat exchanger 21. In this example, the mixed refrigerant is partially liquefied at an intermediate stage of the compressor 801 and the liquid portion in line 803 is pumped to the final high pressure level and combined with the final compressed vapor portion upstream of aftercooler 805. This feature is optional and may be used in any embodiment of the invention.

In the gas expansion refrigeration system of this embodiment, all of the high-pressure nitrogen stream 807 is cooled in warm gas expansion heat exchanger 809 to a temperature close to or colder than that of the incoming substantially liquefied natural gas stream in line 25. A portion of the cooled high-pressure nitrogen stream in line 811 is work expanded in warm expander 813 to an intermediate pressure. The intermediate-pressure expanded nitrogen stream in line 815 is warmed separately in gas expansion heat exchangers 817 and 809 and is sent to an intermediate stage of multistage compressor 819 to reduce power requirements. The remaining high-pressure nitrogen stream in line 819, after further cooling in cold heat exchanger 817, is expanded in cold expander 821 to a lower pressure. The lower-pressure expanded nitrogen stream in line 823 is warmed in cold heat exchanger 817 to provide the coldest level of refrigeration required to subcool incoming substantially liquefied natural gas stream 25.

Optionally, the incoming substantially liquefied natural gas stream 25 may be at a temperature warmer than −100° C. and may be only partially liquefied. In that case, the two expanded nitrogen streams in lines 815 and 823 provide refrigeration to completely liquefy and subcool the incoming substantially liquefied natural gas stream in line 25. The cold gas expansion heat exchanger 817 may be split into two or more heat exchangers, if desired, or the heat exchangers 809 and 817 can be combined into a single heat exchanger.

A feature of this embodiment is that the flow rate of work-expanded nitrogen via line 823 in second heat exchange zone typically is less than the total flow rate of work-expanded nitrogen streams 825 and 827 in third heat exchange zone 809. Typically, no cooling of the feed gas or the cooled feed stream occurs in third heat exchange zone 809.

Figure 9:
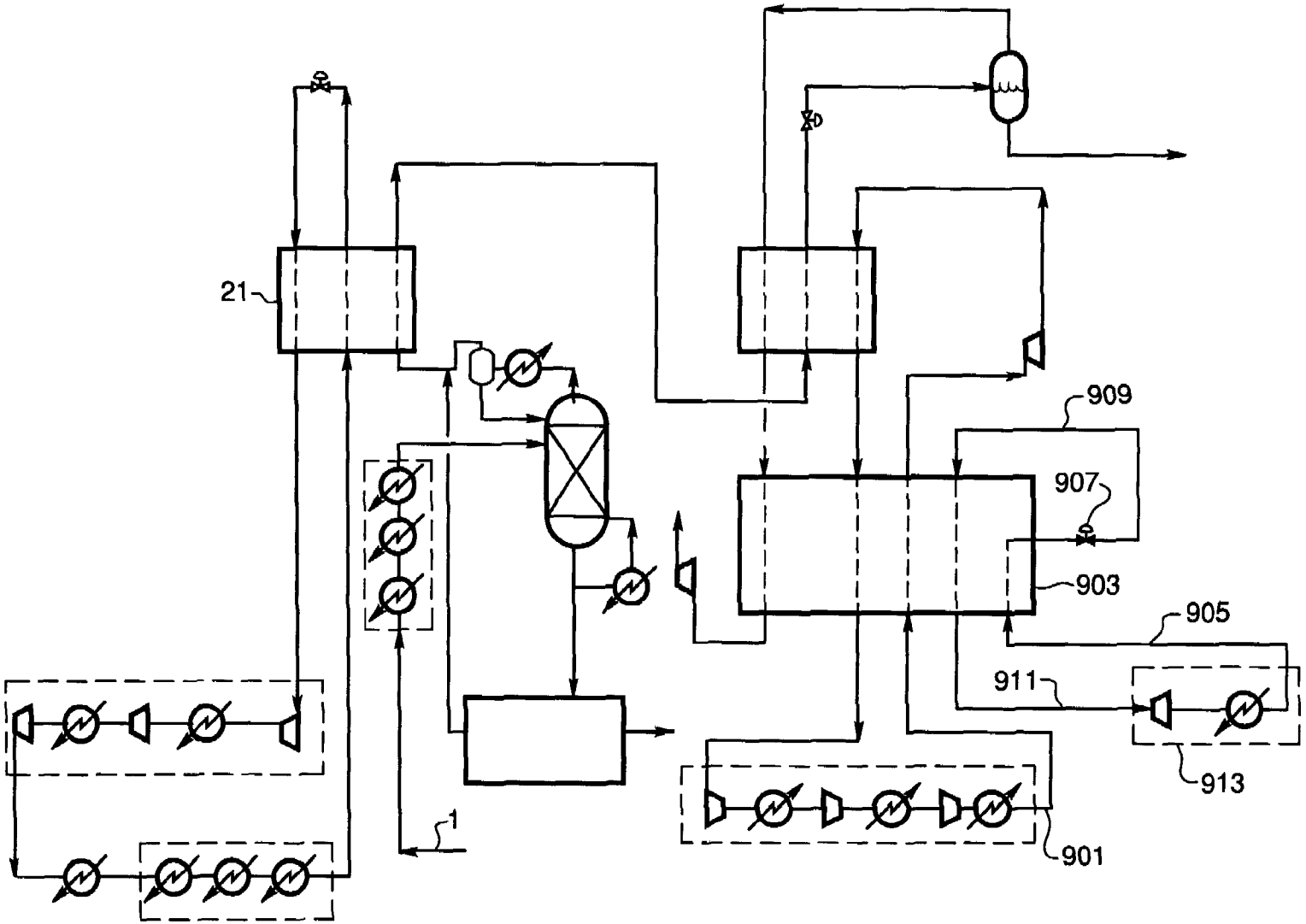
FIG. 9 is a schematic flowsheet of a gas liquefaction process according to another embodiment of the present invention utilizing a single gas expander and two vapor recompression refrigeration cycles.

An alternative embodiment of the invention is shown in FIG. 9. In this embodiment, the high-pressure refrigerant gas stream in line 901 is precooled in the warm gas expansion heat exchanger 903 with a portion of the refrigeration provided by a separate refrigeration system utilizing a mixed refrigerant. The use of this separate refrigeration allows the elimination of the warm nitrogen expander. High-pressure mixed refrigerant stream 905 is cooled and at least partially condensed in warm heat exchanger 903. The cooled high-pressure mixed refrigerant stream in line is flashed across valve 907 or by a dense-phase expander and the reduced-pressure refrigerant flows to the cold end of warm heat exchanger 903 via line 909. The low-pressure mixed refrigerant stream in line 909 is warmed and vaporized in warm heat exchanger 903, exiting as a warmed mixed refrigerant stream in line 911. The warmed low-pressure mixed refrigerant stream in line 911 is compressed to a suitable high pressure in the mixed refrigerant compressor 913 and cooled back to ambient temperature for recycle.

The mixed refrigerant refrigeration system which precools the gas expansion system refrigerant in line 901 is decoupled from the first or warm refrigeration system that provides in heat exchanger 21 at least a portion of the refrigeration required to liquefy the feed gas stream 1. This embodiment of the invention provides an alternate method for the complete separation of the gas expansion refrigeration system from the first refrigeration system without sacrificing thermodynamic efficiency. Any type of first refrigeration system utilizing two or more refrigerant components can be used. An alternative embodiment may use separate mixed-refrigerant circuits in heat exchangers 21 and 903 with combined integrated compression service. Mixed refrigerant in heat exchangers 21 and 903 may have the same composition or may have different compositions achieved by equilibrium separation. A portion of the mixed refrigerant used in heat exchanger 903 may be withdrawn and/or returned between the stages of the integrated compressor.

EXAMPLE

The embodiment of FIG. 1 is illustrated by the following non-limiting Example. Natural gas feed in line 1 is provided at a flow rate of 59,668 kgmoles per hour and has a composition of 3.90 mole % nitrogen, 87.03% methane, 5.50% ethane, 2.02% propane and 1.55% $C_4$ and heavier hydrocarbons ($C_4^+$) at 27° C. and 60.3 bara. The feed has been cleaned and dried in an upstream pretreatment section (not shown), for the removal of acid gases such as $CO_2$ and $H_2S$ along with other contaminants such as mercury. Natural gas feed in line 1 enters the first heat exchanger section 3 and is precooled to −18° C. using several levels of propane refrigeration. The precooled natural gas feed stream in line 5 enters scrub column 7 where the heavier components of the feed, pentane and heavier hydrocarbons, are removed to prevent freezing in the liquefaction process. The scrub column has an overhead condenser 9 which also uses propane refrigeration to provide the reflux to the scrub column. The bottoms product from the scrub column is sent via line 11 to fractionation section 13 where the pentane and heavy components are separated and recovered in line 15. The lighter liquid components in stream 17 at −33° C. are combined with the overhead vapor product of the scrub column to provide a purified natural gas stream in line 19.

Purified natural gas stream in line 19 has a flow rate of 57,274 kgmoles per hour and a composition of 3.95 mole % nitrogen, 87.74% methane, 5.31% ethane, 2.04% propane, and 0.96% $C_4$ and heavier hydrocarbons at −32.9° C. and 58.0 bara. The stream is further cooled to a temperature of −119.7° C. and condensed in mixed refrigerant heat exchanger 21 by warming and vaporizing low-pressure mixed refrigerant provided via line 23. The substantially liquefied natural gas stream in line 25, which in this Example is completely liquefied, is subcooled to a temperature of −150.2° C. in cold gas expansion heat exchanger 27. Refrigeration for cooling in heat exchanger 27 is provided by a cold work-expanded nitrogen refrigerant stream in line 29 from expander 31. The subcooled LNG stream in line 33 is then flashed adiabatically to a pressure of 1.17 bara across valve 35. The low-pressure LNG stream in line 37 at −162.3° C. is sent to separator 39 and the LNG product stream withdrawn via line 41 to storage. The light flash gas stream in line 43 can be warmed and compressed to a pressure sufficient for use as fuel gas in the LNG facility or for other use.

Refrigeration to cool and liquefy the natural gas feed stream 1 in this example is provided by a propane refrigerant circuit and a mixed refrigerant refrigeration circuit. High-pressure mixed refrigerant in line 50 at a flow rate of 51,200 kgmoles per hour having a composition of 36.92 mole % methane, 54.63% ethane and 8.45% propane at 36.5° C. and 61.6 bara is precooled and fully condensed using several levels of propane refrigerant in heat exchanger section 51. The precooled mixed refrigerant stream in line 53 enters mixed refrigerant heat exchanger 21 at −33° C. and 58.9 bara.

The mixed refrigerant is subcooled to a temperature of −120° C. in heat exchanger 21, exiting in line 55. This subcooled mixed refrigerant is flashed adiabatically across valve 57 to −122.5° C. and 4.2 bara and flows via line 23 to the cold end of heat exchanger 21. The low-pressure mixed refrigerant stream in line 23 is warmed and vaporized in heat exchanger 21, exiting as a warmed mixed refrigerant stream in line 45 at −34.5° C. and 3.6 bara. The warmed low-pressure mixed refrigerant stream in line 45 is compressed to 61.6 bara in multi-stage, inter-cooled mixed refrigerant compressor 47 and cooled to ambient temperature for recycle.

Subcooling of the liquefied natural gas in line 25 is accomplished using a multi-expander gas expansion refrigeration system employing nitrogen as the working fluid. High-pressure nitrogen in line 59 at a flow rate of 82,109 kgmoles per hour, a temperature of 36.5° C., and a pressure of 75.9 bara is divided into two portions. The larger high-pressure nitrogen portion in line 61 at 69,347 kgmoles per hour enters warm nitrogen heat exchanger 63 and is cooled to −107.7° C. The cooled high-pressure nitrogen stream in line 65 is work-expanded in cold expander 31 to −152.4° C. and 23.7 bara. The cold work-expanded nitrogen stream in line 29, which is all vapor in this example, is warmed in cold nitrogen heat exchanger 27 and is withdrawn at −121.9° C. to provide the cold refrigeration required to subcool the LNG in line 25. The smaller high-pressure nitrogen stream in line 69 at 12,762 kgmoles per hour is precooled in heat exchanger section 71 to −33.1° C. using several levels of propane refrigerant. The precooled high-pressure nitrogen stream in line 73 is then work expanded in warm expander 75 to −96° C. and 23.4 bara. The work-expanded nitrogen stream in line 77 is combined with the warmed nitrogen stream in line 67 from cold heat exchanger 27 and flows to warm heat exchanger 63 via line 79 at −118.1° C. The combined nitrogen stream in line 79 is warmed to 27.8° C. in warm heat exchanger 63, and withdrawn refrigerant in line 81 is compressed to 75.9 bara in multi-stage, inter-cooled nitrogen compressor 83 and cooled back to ambient temperature for recycle.

The addition of the smaller expanded nitrogen stream in line 29 for warming in warm nitrogen heat exchanger 27 maintains the cooling curves in exchanger 27 at close to ideal, that is, the warming and cooling curves of the fluids closely approach each other along their entire lengths, thereby improving the process efficiency. It is not necessary to provide a balance stream of vaporizing mixed refrigerant to warm gas expansion heat exchanger 63 or alternatively to cool a portion of the high-pressure refrigerant gas in line 73 in mixed refrigerant heat exchanger 21 in order to attain more closely parallel cooling curves. This example of the invention, and the embodiments described earlier with reference to FIGS. 1–5, 7, and 8, illustrate the independent operation of the first refrigeration system and the gas expansion refrigeration system.

The invention claimed is:

1. A method for gas liquefaction comprising:

(a) cooling a feed gas in a first heat exchange zone by indirect heat exchange with one or more refrigerant streams provided in a first refrigeration system, and withdrawing a substantially liquefied stream from the first heat exchange zone;

(b) further cooling the substantially liquefied stream in a second heat exchange zone by indirect heat exchange with one or more work-expanded refrigerant streams provided by a second refrigeration system and withdrawing a further cooled, substantially liquefied stream from the second heat exchange zone; and (c) work expanding two or more cooled compressed refrigerant streams in the second refrigeration system to provide at least one of the one or more work-expanded refrigerant streams in the second heat exchange zone, wherein the operation of the second refrigeration system includes the steps of (1) compressing one or more refrigerant gases to provide a compressed refrigerant stream;

(2) cooling all or a portion of the compressed refrigerant stream in a third heat exchange zone to provide a cooled, compressed refrigerant stream; and (3) work expanding the cooled, compressed refrigerant stream to provide one of the one or more work-expanded refrigerant streams;

wherein the flow rate of a work-expanded refrigerant stream in the second heat exchange zone is less than the total flow rate of one or more work-expanded refrigerant streams in the third heat exchange zone.

2. The method of claim 1 wherein no cooling of the feed gas or the cooled feed stream occurs in the third heat exchange zone.

3. The method of claim 1 wherein the flow rate of a compressed refrigerant stream being cooled in the third heat exchange zone is less than the total flow rate of one or more work-expanded refrigerant streams being warmed in the third heat exchange zone.

4. The method of claim 1 wherein the first refrigeration system operates independently of the second refrigeration system.

5. The method of claim 1 wherein the cooling of the feed gas in the first heat exchange zone is effected by a method comprising (d) compressing and cooling a refrigerant gas containing one or more components to provide a cooled and at least partially condensed refrigerant;

(e) reducing the pressure of the cooled and at least partially condensed refrigerant to provide a vaporizing refrigerant and cooling the feed gas by indirect heat exchange with the vaporizing refrigerant in the first heat exchange zone to provide the substantially liquefied stream and the refrigerant gas of (d).

6. The method of claim 5 wherein the feed gas is cooled prior to the first heat exchange zone by indirect heat exchange with a second vaporizing refrigerant.

7. The method of claim 5 wherein at least a portion of the cooling of the refrigerant gas in (d) is provided by indirect heat exchange with a second vaporizing refrigerant.

8. The method of claim 1 wherein a first portion of the compressed refrigerant gas is cooled in the third heat exchange zone and wherein a second portion of the compressed refrigerant gas is cooled, work expanded, and warmed in the third heat exchange zone to provide refrigeration therein for cooling the first portion of the compressed refrigerant gas.

9. The method of claim 1 wherein the compressed refrigerant gas is cooled in the third heat exchange zone and work expanded to provide a first work-expanded refrigerant, the first work-expanded refrigerant is divided into a first and a second cooled refrigerant, the first cooled refrigerant is warmed in the third heat exchange zone to provide refrigeration therein for cooling the compressed refrigerant gas, the second cooled refrigerant is further cooled and work expanded to provide a second work-expanded refrigerant, and the second work-expanded refrigerant is warmed in the second heat exchange zone to provide refrigeration therein for cooling the substantially liquefied stream from the first heat exchange zone.

10. The method of claim 1 wherein a first portion of the compressed refrigerant gas is cooled in the third heat exchange zone and work expanded to provide a first work-expanded refrigerant, a second portion of the compressed refrigerant gas is cooled by indirect heat exchange with a vaporizing refrigerant provided by a third refrigeration system and work expanded to provide a second work-expanded refrigerant, and the first and second work-expanded refrigerants are warmed in the second heat exchange zone to provide refrigeration therein for cooling the substantially liquefied stream from the first heat exchange zone.

11. The method of claim 1 wherein the compressed refrigerant gas is cooled in the third heat exchange zone to provide a cooled compressed refrigerant gas, and wherein a portion of the cooled compressed refrigerant gas is work expanded and warmed in the second heat exchange zone to provide cooling therein for the substantially liquefied stream from the first heat exchange zone.

12. The method of claim 1 wherein the second refrigeration system is operated by a method comprising (d) compressing a first refrigerant gas to provide the compressed refrigerant gas, and dividing the compressed refrigerant gas into first and second compressed refrigerants;

(e) cooling the first compressed refrigerant in the third heat exchange zone to provide a first cooled compressed refrigerant, work expanding the first cooled compressed refrigerant to provide a cold work-expanded refrigerant, warming the cold work-expanded refrigerant in the second heat exchange zone to provide refrigeration for cooling the cooled feed stream therein, and withdrawing an intermediate refrigerant therefrom;

(f) cooling the second compressed refrigerant by indirect heat exchange with a vaporizing refrigerant to provide a second cooled compressed refrigerant, work expanding the second cooled compressed refrigerant to provide a work-expanded second refrigerant, and combining the work expanded second refrigerant with the intermediate refrigerant to provide a combined intermediate refrigerant; and (g) warming the combined intermediate refrigerant in the third heat exchange zone to provide refrigeration for cooling the first compressed refrigerant therein, and withdrawing therefrom a warm refrigerant to provide the first refrigerant gas.

13. The method of claim 1 wherein the second refrigeration system is operated by a method comprising (d) compressing a first refrigerant gas to provide the compressed refrigerant gas;

(e) cooling the compressed refrigerant gas in the third heat exchange zone to provide a cooled compressed refrigerant, and dividing the cooled compressed refrigerant into a first and a second cooled compressed refrigerant;

(f) further cooling the first cooled compressed refrigerant in the third heat exchange zone to provide a first further cooled refrigerant;

(g) work expanding the first further cooled refrigerant to provide a work-expanded first refrigerant and work expanding the second cooled compressed refrigerant to provide a work-expanded second refrigerant;

(h) warming the first work-expanded refrigerant and the second work-expanded refrigerant in the second heat exchange zone to provide refrigeration therein for cooling the substantially liquefied stream from the first heat exchange zone and withdrawing a combined intermediate refrigerant from the second heat exchange zone; and (i) warming the combined intermediate refrigerant in the third heat exchange zone to provide refrigeration for cooling the first compressed refrigerant therein and withdrawing therefrom a warmed refrigerant to provide the first refrigerant gas.

14. The method of claim 1 wherein the second refrigeration system is operated by a method comprising (d) compressing the first refrigerant gas and a second refrigerant gas in a multi-stage refrigerant compressor to provide a compressed refrigerant gas, and dividing the compressed refrigerant gas into a first and a second compressed refrigerant;

(e) cooling the first compressed refrigerant in the third heat exchange zone to provide a first cooled compressed refrigerant and work expanding the first cooled compressed refrigerant to provide a cold work-expanded refrigerant at a first pressure, and warming the cold work-expanded refrigerant in the second heat exchange zone to provide refrigeration therein for cooling the substantially liquefied stream from the first heat exchange zone and withdrawing an intermediate refrigerant from the second heat exchange zone;

(f) cooling the second compressed refrigerant by indirect heat exchange with a vaporizing refrigerant to provide a second cooled compressed refrigerant, work expanding the second cooled compressed refrigerant to provide a work-expanded second refrigerant at a second pressure greater than the first pressure, warming the work-expanded second refrigerant in the third heat exchange zone to provide refrigeration for cooling the first compressed refrigerant therein, and withdrawing therefrom a warmed refrigerant to provide the second refrigerant gas;

(g) warming the intermediate refrigerant in the third heat exchange zone to provide refrigeration for cooling the first compressed refrigerant therein, and withdrawing therefrom a warmed refrigerant to provide the first refrigerant gas; and (h) introducing the first refrigerant gas into a first stage of the multi-stage refrigerant compressor and introducing the second refrigerant gas into an intermediate stage of the multi-stage refrigerant compressor.

15. The method of claim 1 wherein the second refrigeration system is operated by a method comprising (d) compressing a refrigerant gas to provide the compressed refrigerant gas, and dividing the compressed refrigerant gas into a first and a second compressed refrigerant;

(e) cooling the first compressed refrigerant in the third heat exchange zone to provide a first cooled compressed refrigerant and work expanding the first cooled compressed refrigerant to provide a first work-expanded refrigerant;

(f) cooling the first work-expanded refrigerant in the second heat exchange zone to provide a cooled first work-expanded refrigerant, work expanding the cooled first work-expanded refrigerant to provide a cold work-expanded refrigerant, warming the cold work-expanded refrigerant in the second heat exchange zone to provide refrigeration therein for cooling the substantially liquefied stream from the first heat exchange zone, and withdrawing an intermediate refrigerant from the second heat exchange zone;

(g) cooling the second compressed refrigerant by indirect heat exchange with a vaporizing refrigerant to provide a second cooled compressed refrigerant, work expanding the second cooled compressed refrigerant to provide a work-expanded second refrigerant, and combining the work-expanded second refrigerant with the intermediate refrigerant to provide a combined refrigerant; and (h) warming the combined refrigerant in the third heat exchange zone to provide refrigeration for cooling the first compressed refrigerant therein and withdrawing therefrom the first refrigerant gas.

16. The method of claim 1 wherein the second refrigeration system is operated by a method comprising (d) compressing a first refrigerant gas and a second refrigerant gas in a multi-stage refrigerant compressor to provide the compressed refrigerant gas;

(e) cooling the compressed refrigerant gas in the third heat exchange zone to provide a first cooled compressed refrigerant, work expanding the first cooled compressed refrigerant to provide a first cold work-expanded refrigerant at a first pressure, and dividing the first cold work-expanded refrigerant into a first and a second cold refrigerant;

(f) warming the first cold refrigerant in the third heat exchange zone to provide refrigeration for cooling the first compressed refrigerant therein and withdrawing therefrom a warmed refrigerant to provide the second refrigerant gas;

(g) cooling the second cold refrigerant in the second heat exchange zone to provide a second cooled compressed refrigerant, work expanding the second cooled compressed refrigerant to provide a second work-expanded refrigerant at a second pressure that is less than the first pressure;

(h) warming the second work-expanded refrigerant in the second heat exchange zone to provide refrigeration therein for cooling the substantially liquefied stream from the first heat exchange zone and to provide refrigeration for cooling the first compressed refrigerant in the third heat exchange zone, and withdrawing therefrom a warmed refrigerant to provide the first refrigerant gas; and (i) introducing the first refrigerant gas into a first stage of the multi-stage refrigerant compressor and introducing the second refrigerant gas into an intermediate stage of the multi-stage refrigerant compressor.

17. The method of claim 1 wherein the second refrigeration system is operated by a method comprising (d) compressing a refrigerant gas to provide the compressed refrigerant gas, and dividing the compressed refrigerant gas into a first and a second compressed refrigerant;

(e) cooling the first compressed refrigerant in the third heat exchange zone to provide a first cooled compressed refrigerant and work expanding the first cooled compressed refrigerant to provide a cold work-expanded first refrigerant, warming the cold work-expanded first refrigerant in the second heat exchange zone to provide refrigeration therein for cooling the substantially liquefied stream from the first heat exchange zone, and form a partially-warmed refrigerant in the second heat exchange zone;

(f) cooling the second compressed refrigerant by indirect heat exchange with a vaporizing refrigerant to provide an intermediate cooled refrigerant, further cooling the intermediate cooled refrigerant in the third heat exchange zone to provide a cooled second compressed refrigerant, and work expanding the second cooled compressed refrigerant to provide a work-expanded second refrigerant;

(g) combining the cold work-expanded second refrigerant and the partially-warmed refrigerant to provide a combined intermediate refrigerant, warming the combined intermediate refrigerant in the second heat exchange zone to provide additional refrigeration therein for cooling the substantially liquefied stream from the first heat exchange zone, and withdrawing a partially warmed refrigerant from the second heat exchange zone; and (h) warming the partially warmed refrigerant in the third heat exchange zone to provide refrigeration for cooling the first compressed refrigerant and the second compressed refrigerant therein, and withdrawing therefrom a warmed refrigerant to provide the first refrigerant gas.

18. The method of claim 17 which further comprises providing additional refrigeration to the third heat exchange zone by warming therein a portion of the one or more refrigerants provided in the first refrigeration system.

19. The method of claim 17 which further comprises providing additional refrigeration to the first heat exchange zone by warming therein a portion of the intermediate cooled refrigerant provided in the second refrigeration system.

20. The method of claim 1 wherein the second refrigeration system is operated by a method comprising (d) compressing a first refrigerant gas and a second refrigerant gas in a multi-stage refrigerant compressor to provide the compressed refrigerant gas;

(e) cooling the compressed refrigerant gas in the third heat exchange zone to provide a cooled compressed refrigerant and dividing the cooled compressed refrigerant into a first and a second cooled refrigerant;

(f) work expanding the first cooled refrigerant to provide a first work-expanded refrigerant at a first pressure, warming the first work-expanded refrigerant in the second heat exchange zone to provide refrigeration therein for cooling the substantially liquefied stream from the first heat exchange zone and to provide refrigeration for cooling the first compressed refrigerant in the third heat exchange zone, and withdrawing therefrom a warmed refrigerant to provide the second refrigerant gas;

(g) cooling the second cooled refrigerant in the second heat exchange zone to provide a second cooled compressed refrigerant, work expanding the second cooled compressed refrigerant to provide a second work-expanded refrigerant at a second pressure that is less than the first pressure;

(h) warming the second work-expanded refrigerant to provide refrigeration for cooling the cooled feed stream in the second heat exchange zone and to provide refrigeration for cooling the first compressed refrigerant in the third heat exchange zone, and withdrawing therefrom a warmed refrigerant to provide the first refrigerant gas; and (i) introducing the first refrigerant gas into a first stage of the multi-stage refrigerant compressor and introducing the second refrigerant gas into an intermediate stage of the multi-stage refrigerant compressor.

21. The method of claim 1 wherein the feed gas comprises natural gas.

22. The method of claim 1 wherein the one or more refrigerants provided in the first refrigeration system are selected from the group consisting of nitrogen, hydrocarbons containing one or more carbon atoms, and halocarbons containing one or more carbon atoms.

23. The method of claim 1 wherein the refrigerant gas in the second refrigeration system comprises one or more components selected from the group consisting of nitrogen, argon, methane, ethane, and propane.

24. A method for gas liquefaction comprising:

(a) cooling a feed gas in a first heat exchange zone by indirect heat exchange with one or more ref refrigerants provided in a first refrigeration system, and withdrawing a substantially liquefied stream from the first heat exchange zone; and (b) further cooling the substantially liquefied stream in a second heat exchange zone by indirect heat exchange with a cold work-expanded refrigerant and withdrawing therefrom a further cooled, substantially liquefied stream; wherein the cold work-expanded refrigerant is provided in a second refrigeration system comprising at least two refrigeration circuits by a method which includes (1) compressing a refrigerant gas in a first refrigeration circuit to provide a compressed refrigerant gas;

(2) cooling the compressed refrigerant gas in a third heat exchange zone to provide a cooled, compressed refrigerant gas, wherein a portion of the cooling is provided therein by vaporizing a multicomponent refrigerant provided by a second refrigeration circuit;

(3) work expanding the cooled, compressed refrigerant gas to provide the cold work-expanded refrigerant; and (4) warming the cold work-expanded refrigerant in the second heat exchange zone to provide refrigeration therein for cooling the substantially liquefied stream from the first heat exchange zone and to provide refrigeration for cooling the compressed refrigerant gas in the third heat exchange zone, and withdrawing therefrom a warmed refrigerant to provide the refrigerant gas.

25. The method of claim 24 wherein no cooling of the feed gas or the cooled feed stream occurs in the third heat exchange zone.

26. In a method for gas liquefaction comprising (a) cooling a feed gas in a first heat exchange zone by indirect heat exchange with one or more refrigerants provided in a first refrigeration system, thereby providing a cooled feed stream; and (b) further cooling the cooled feed stream in a second heat exchange zone by indirect heat exchange with a work-expanded refrigerant provided by a second refrigeration system and withdrawing a further cooled stream from the second heat exchange zone, wherein the operation of the second refrigeration system includes the steps of (1) compressing a refrigerant gas to provide a compressed refrigerant;

(2) cooling the compressed refrigerant to provide a cooled, compressed refrigerant;

(3) work expanding the cooled, compressed refrigerant to provide the work-expanded refrigerant; wherein refrigeration for the cooling of the compressed refrigerant is provided in part by indirect heat exchange in a third heat exchange zone with work-expanded refrigerant from the second heat exchange zone and in part by balance refrigeration provided by the first refrigeration system;

the improvement comprising reducing or eliminating the need for the balance refrigeration by cooling and work expanding a portion of the compressed refrigerant to provide an additional work-expanded refrigerant, and utilizing the additional work-expanded refrigerant to provide additional refrigeration to the third heat exchange zone.

27. A system for gas liquefaction comprising:

(a) a first refrigeration system and first heat exchange means adapted for cooling a feed gas by indirect heat exchange with one or more refrigerants provided by the first refrigeration system in order to provide a substantially liquefied stream;

(b) a second refrigeration system and second heat exchange means adapted for further cooling of the substantially liquefied stream by indirect heat exchange with one or more cold work-expanded refrigerants provided by the second refrigeration system in order to provide a further cooled, substantially liquefied stream;

(c) gas compression means for compressing one or more refrigerant gas streams and third heat exchange means adapted for cooling one or more compressed refrigerant gas streams in the second refrigeration system;

(d) two or more expanders for work expanding cooled compressed refrigerant gas streams in the second refrigeration system to provide two or more cold work-expanded refrigerant streams; and (e) piping means to transfer the two or more cold work-expanded refrigerant streams from the two or more expanders to the second heat exchange means or to the second and third heat exchange means.

28. The system of claim 27 wherein the third heat exchange means is not adapted for cooling of the feed gas or the cooled feed stream.

29. The system of claim 27 which further comprises a third refrigeration system adapted for cooling at least one of the one or more compressed refrigerant gas streams of the second refrigeration system.

30. The system of claim 29 wherein the third refrigeration system is adapted for cooling the feed gas prior to the first heat exchange means.

31. A system for gas liquefaction comprising:

(a) a first refrigeration system and first heat exchange means adapted for cooling a feed gas by indirect heat exchange with one or more refrigerants provided by the first refrigeration system in order to provide a substantially liquefied stream;

(b) a second refrigeration system and second heat exchange means adapted for further cooling of the substantially liquefied stream by indirect heat exchange with one or more cold work-expanded refrigerants provided by the second refrigeration system in order to provide a further cooled, substantially liquefied stream;

(c) gas compression means for compressing a refrigerant gas stream and third heat exchange means adapted for cooling one or more compressed refrigerant streams;

(d) a third refrigeration system adapted to provide additional refrigeration to the third heat exchange means;

(e) an expander for work expanding a cooled compressed refrigerant stream in the second refrigeration system to provide a cold work-expanded refrigerant stream; and (f) piping means to transfer the cold work-expanded refrigerant stream from the expander to the second heat exchange means.

32. The system of claim 31 wherein the third heat exchange means is not adapted for cooling of the feed gas or the cooled feed stream.

* * * * *

UNITED STATES PATENT AND TRADEMARK OFFICE

CERTIFICATE OF CORRECTION

PATENT NO. : 7,127,914 B2
APPLICATION NO. : 10/664336
DATED : October 31, 2006
INVENTOR(S) : Mark Julian Roberts et al.

It is certified that error appears in the above-identified patent and that said Letters Patent is hereby corrected as shown below:

Column 27, claim 24, Line 67
Remove "ref" before the word "refrigerants"

Signed and Sealed this

Second Day of January, 2007

JON W. DUDAS
*Director of the United States Patent and Trademark Office*